US010788776B2

(12) United States Patent
Yonekubo

(10) Patent No.: US 10,788,776 B2
(45) Date of Patent: Sep. 29, 2020

(54) IMAGE HEATING APPARATUS, IMAGE FORMING APPARATUS AND CONTROL METHOD OF IMAGE FORMING APPARATUS

(71) Applicant: CANON KABUSHIKI KAISHA, Tokyo (JP)

(72) Inventor: Hideaki Yonekubo, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/687,958

(22) Filed: Nov. 19, 2019

(65) Prior Publication Data

US 2020/0166876 A1 May 28, 2020

(30) Foreign Application Priority Data

Nov. 22, 2018 (JP) ..... 2018-218910

(51) Int. Cl.
*G03G 15/20* (2006.01)

(52) U.S. Cl.
CPC ..... *G03G 15/2042* (2013.01); *G03G 15/2053* (2013.01); *G03G 2215/00805* (2013.01)

(58) Field of Classification Search
CPC ..... G03G 15/2039; G03G 15/2042; G03G 15/2053
See application file for complete search history.

(56) References Cited

U.S. PATENT DOCUMENTS

| | | | | |
|---|---|---|---|---|
| 10,185,258 | B2 | 1/2019 | Sako et al. | |
| 2014/0219696 | A1* | 8/2014 | Fujimoto | G03G 15/2042 399/334 |
| 2015/0331372 | A1* | 11/2015 | Takagi | G03G 15/2039 399/69 |
| 2018/0004135 | A1* | 1/2018 | Sako | G03G 15/2042 |
| 2018/0217541 | A1* | 8/2018 | Nomura | G03G 15/2042 |

FOREIGN PATENT DOCUMENTS

| | | | |
|---|---|---|---|
| JP | 06-95540 | A | 4/1994 |
| JP | 2018-004938 | A | 1/2018 |

* cited by examiner

*Primary Examiner* — Thomas S Giampaolo, II
(74) *Attorney, Agent, or Firm* — Venable LLP

(57) ABSTRACT

In an image heating apparatus, a region of a recording material, on which an image can be formed, is divided into a boundary region and a non-boundary region so as to correspond to a plurality of heating elements. The boundary region includes a boundary between one heating element out of the plurality of heating elements and an adjacent heating element thereof, and overlap with the one heating element and the adjacent heating element overlap in a predetermined range in the orthogonal direction. The non-boundary region overlaps with the one heating element in a range other than the boundary region. A control target temperature of a heating region that is heated by the one heating element is set to a higher temperature of a first temperature based on information corresponding to the boundary region, and a second temperature based on information corresponding to the non-boundary region.

18 Claims, 18 Drawing Sheets

CASE 1

CASE 2

IMAGE HEATING APPARATUS, IMAGE FORMING APPARATUS AND CONTROL METHOD OF IMAGE FORMING APPARATUS

BACKGROUND OF THE INVENTION

Field of the Invention

The present invention relates to an image forming apparatus, such as a printer, a copier and facsimile, using an electrophotographic system or an electrostatic recording system. The present invention also relates to an image heating apparatus, such as a glossing apparatus to improve the gloss of a toner image, by reheating a toner image fixed to a fixing unit or a recording material in the image forming apparatus.

Description of the Related Art

In an image heating apparatus, such as a fixing unit and a glossing apparatus, used for an electrophotographic image forming apparatus (hereafter "image forming apparatus"), such as a copier and a printer, a system to selectively heat an image portion formed on a recording medium was proposed for power saving (Japanese Patent Application Publication H06-95540). According to this system, a plurality of divided heating regions are set in a direction corresponding to the longer direction of the heater (hereafter "longer direction"), which is orthogonal to the transporting direction of the recording material, and a plurality of heating elements which heats the heating regions respectively, are disposed in the longer direction. Then based on the image information on the image that is formed in each heating region, the heating value of the corresponding heating element is controlled. For example, the control temperature for each heating region, where no image exists (hereafter "non-image heating portion"), is set to be lower than the control temperature for a heating region where an image is included (hereafter "image heating portion").

In the configuration having a plurality of heating regions which are divided in the longer direction, a temperature gradient is generated in the vicinity of a boundary position between a non-image heating portion and an image heating portion adjacent thereto, because of the difference between the control temperatures of these portions. This may generate a fixing failure and a drop in gloss in the vicinity of the edge of the image on the boundary position side.

To solve this problem, Japanese Patent Application Publication No. 2018-4938 discloses an image forming apparatus that changes the temperature of the image heating portion adjacent to the boundary position in accordance with the distance between the boundary position and the edge of the image in the longer direction. This content will be described with reference to FIG. 17. In FIGS. 17, 903-1, 903-2 and 903-3 indicate the heating elements divided in the longer direction. 910 indicates an image where the image 910 exists only in the region of 903-2. 903-2 is an image heating portion, and 903-1 and 903-3 are a non-image heating portion. The image forming apparatus calculates position information of the image, and controls the temperature of 903-2, which is an image heating portion, in accordance with the distance (indicated by arrow y in FIG. 17) between the edge of the image of 903-2 and the boundary position between 903-1 and 903-2, so as to implement both the fixing performance and power saving.

SUMMARY OF THE INVENTION

The control method of Japanese Patent Application Publication No. 2018-4938, however, has the following problem. This problem is related to the method of calculating the position information of the image. FIGS. 18A and 18C indicate a portion of 903-1 and 903-2 in FIG. 17, omitting 903-3. FIG. 18A illustrates a state of the heating elements 903-1 and 903-2, which are divided in the longer direction. FIG. 18B indicates the position of the images, where image A is an image in the region of 903-1, and image B is an image in the region of 903-2. FIG. 18C indicates the temperatures of the heating elements 903-1 and 903-2.

In Japanese Patent Application Publication No. 2018-4938, the image A exists in the region of 903-1 and the image B exists in the region of 903-2, as illustrated in FIG. 18B, hence both 903-1 and 903-2 are image heating portions. Therefore, the fixing temperature is the temperature indicated by the dotted line in FIG. 18C (e.g. 200 deg. for both 903-1 and 903-2). However, if the image A is a low print percentage pattern that can be fixed at a temperature lower than the image B, for example, the temperature of 903-1 may be lower (e.g. 163 deg.).

As indicated by the solid line in FIG. 18C, if there is a temperature difference between 903-1 and 903-2, the temperature changes in the vicinity of the boundary position between 903-1 and 903-2, because of the influence of thermal diffusion. Therefore, even if the temperature of 903-1 is decreased (e.g. to 150 deg.), the fixing temperature (163 deg.) of the image A can be satisfied. By determining the temperature of 903-1 like this, in accordance with the distance from the edge of the image, based on a position which considers the temperature change in the vicinity of the boundary position between 903-1 and 903-2, such as a position of the inflection point (e.g. position Z) in FIG. 18C, for example, power can be further saved. In the control method disclosed in Japanese Patent Application Publication No. 2018-4938, the temperature of 903-1 is determined in accordance with the distance from the edge of the image based on the dividing position of the heating elements of 903-1 and 903-2. Hence the temperature of 903-1 may be increased in a case where the fixing performance can still be satisfied even if the temperature of 903-1 is decreased, hence more consideration is required for further power saving.

It is an object of the present invention to provide a technique that implements a further power supply saving effect in a configuration where heating control is performed for a plurality of heating regions independently by a plurality of heating elements disposed in the longer direction, while preventing the generation of a fixing failure and a drop in gloss in a vicinity of the edges of the image.

To achieve the above object, an image heating apparatus that heats an image formed on a recording material according to the present invention includes:

a heater including a plurality of heating elements which are arranged in a direction orthogonal to a transporting direction of a recording material;

a control portion capable of individually controlling power to be supplied to the plurality of heating elements so as to individually control the temperature of a plurality of heating regions which are heated by the plurality of heating elements; and an acquisition portion that acquires information on an image formed on a recording material, wherein the control portion divides a region of a recording material, on which an image is formable, into a boundary region and a non-boundary region which are regions divided in a direction orthogonal to the transporting direction so as to correspond to the plurality of heating elements, the boundary region is a region which includes a boundary between one heating element, out of the plurality of heating elements, and an adjacent heating element thereof and overlap with the one heating element and the adjacent heating element by a predetermined range in the direction orthogonal to the transporting direction, and the non-boundary region is a region that overlaps with the one heating element in a range other than the boundary region, wherein a control target temperature of a heating region that is heated by the one heating element is set to a higher temperature of a first temperature based on information corresponding to the boundary region out of the image information, and a second temperature based on information corresponding to the non-boundary region out of the image information.

To achieve the above object, an image forming apparatus according to the present invention includes:

an image forming portion that forms an image on a recording material; and a fixing portion that fixes an image formed on a recording material to the recording material, wherein the fixing portion is the image heating apparatus according to the present invention.

To achieve the above object, in a control method of an image heating apparatus that heats an image formed on a recording material according to the present invention includes:

a heater including a plurality of heating elements which are arranged in a direction orthogonal to a transporting direction of a recording material;

a control portion capable of individually controlling power to be supplied to the plurality of heating elements so as to individually control temperatures of a plurality of heating regions which are heated by the plurality of heating elements; and an acquisition portion that acquires information on an image formed on a recording material, the control method comprising:

a first step where a region of a recording material, on which an image is formable, is divided into a boundary region and a non-boundary region which are regions divided in a direction orthogonal to the transporting direction so as to correspond to the plurality of heating elements, the boundary region is a region which includes a boundary between one heating element, out of the plurality of heating elements, and an adjacent heating element thereof and overlap with the one heating element and the adjacent heating element by a predetermined range in the direction orthogonal to the transporting direction, and the non-boundary region is a region that overlaps with the one heating element in a range other than the boundary region, and a first temperature based on information corresponding to the boundary region out of the image information, and a second temperature based on information corresponding to the non-boundary region out of the image information are acquired; and a second step where the control target temperature of a heating region that is heated by the one heating element is set to be a higher temperature of the first temperature and the second temperature.

According to the present invention, a further power saving effect is implemented in a configuration where heating control is performed for a plurality of heating regions independently by a plurality of heating elements disposed in the longer direction, while preventing the generation of a fixing failure and a drop in gloss in a vicinity of the edges of the image.

Further features of the present invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

Embodiment 1

1. Configuration of Image Forming Apparatus

Figure 1:
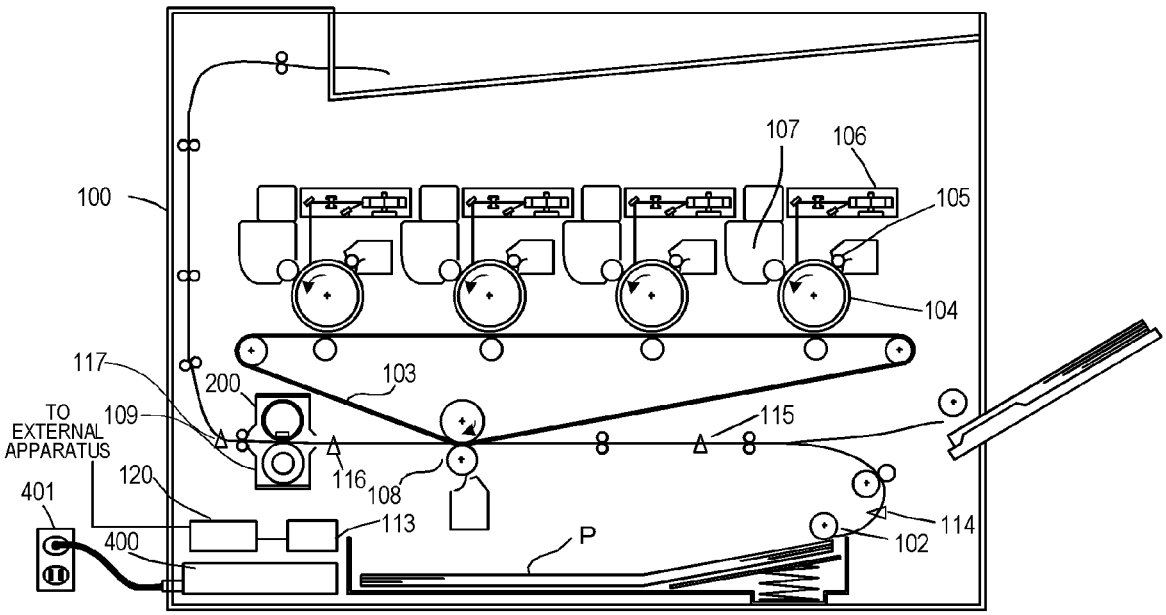
FIG. 1 is a cross-sectional view of an image forming apparatus.

FIG. 1 is a configuration diagram depicting an example of an electrophotographic type image forming apparatus according to an embodiment of the present invention. Image forming apparatuses to which the present invention can be applied are a copier and a printer that uses an electrophotographic system or electrostatic recording system, and a case of applying the present invention to a laser printer will be described here.

The image forming apparatus 100 includes a video controller 120 and a control unit (control portion) 113. The video controller 120 receives and processes image information and print instructions which are sent from such an external apparatus as a personal computer, as an acquisition portion that acquires information on an image to be formed on a recording material. The control unit 113 is connected with the video controller 120, and controls each component constituting the image forming apparatus 100, in accordance with the instruction from the video controller 120. When the video controller 120 receives a print instruction from the external apparatus, the following operation to form the image is executed.

The image forming apparatus 100 feeds a recording material P using a feed roller 102 and transports the recording material P toward an intermediate transfer member 103. Each photosensitive drum 104 is rotary-driven counterclockwise by the power of a drive motor (not illustrated) at a predetermined speed and is uniformly charged by a primary charging device 105 during this rotation process. A laser beam, which was modulated corresponding to an image signal, is outputted from a laser beam scanner 106, and selectively scans and exposes the photosensitive drum 104 so as to form an electrostatic latent image. 107 indicates a developing device and visualizes the electrostatic latent image as a toner image (developer image) by attaching powder toner, which is a developer, to the electrostatic latent image. The toner image formed on the photosensitive drum 104 is primarily transferred onto an intermediate transfer member 103 which rotates in contact with the photosensitive drum 104.

The photosensitive drum 104, the primary charging device 105, the laser beam scanner 106 and the developing device 107 are disposed for four colors (cyan (C), magenta (M), yellow (Y) and black (K)) respectively. Four colors of toner images are transferred on the intermediate transfer member 103 sequentially so as to be superimposed by the same procedure. The toner images transferred onto the intermediate transfer member 103 are secondarily transferred onto the recording material P by a secondary transfer portion which is constituted of the intermediate transfer member 103 and a transfer roller 108, using the transfer bias applied to the transfer roller 108. The configuration related to forming an unfixed image on the recording material P corresponds to the image forming portion according to the present invention. The toner image is then fixed by a fixing apparatus (image heating apparatus) 200, which is a fixing portion (image fixing portion) that performs heating and pressing of the recording material P, and the recording material P is discharged from the apparatus as an image forming matter.

The image forming apparatus 100 of Embodiment 1 supports a plurality of recording material sizes and can print images on various sizes of recording materials which are set in a paper feeding cassette 11. The types of recoding materials are, for example, Letter size (about 216 mm×279 mm), Legal size (about 216 mm×356 mm), A4 size (210 mm×297 mm), and Executive size (about 184 mm×267 mm). B5 size (182 mm×257 mm) and A5 size (148 mm×210 mm) are also supported. Irregular sized paper, including DL envelope (110 mm×220 mm) and COM10 envelope (about 105 mm×241 mm) can also be printed. The image forming apparatus 100 of Embodiment 1 is a laser printer which basically feeds the recording material in the vertical direction (transports the recording material so that the longer side of the recording material is parallel with the transporting direction). The largest (widest) size of the widths of the standard size recording materials (widths of recording materials specified in catalog) that this apparatus supports is about a 216 mm width of Letter size and Legal size paper.

The control unit 113 manages the transporting state of the recording material P using a transport sensor 114, a resist sensor 115, a prefixing sensor 116, and a fixed paper discharge sensor 117, disposed on the transport path of the recording material P. The control unit 113 also includes a storage portion that stores a temperature control program and a temperature control table of the fixing apparatus 200. Using the later mentioned method, the control unit 113 controls the temperature of the fixing apparatus 200 based on the image information received from the video controller 120. A control circuit 400, which is a heater driving unit connected to the commercial AC power supply 401, supplies power to the fixing apparatus 200.

2. Configuration of Fixing Apparatus (Image Heating Apparatus)

Figure 2:
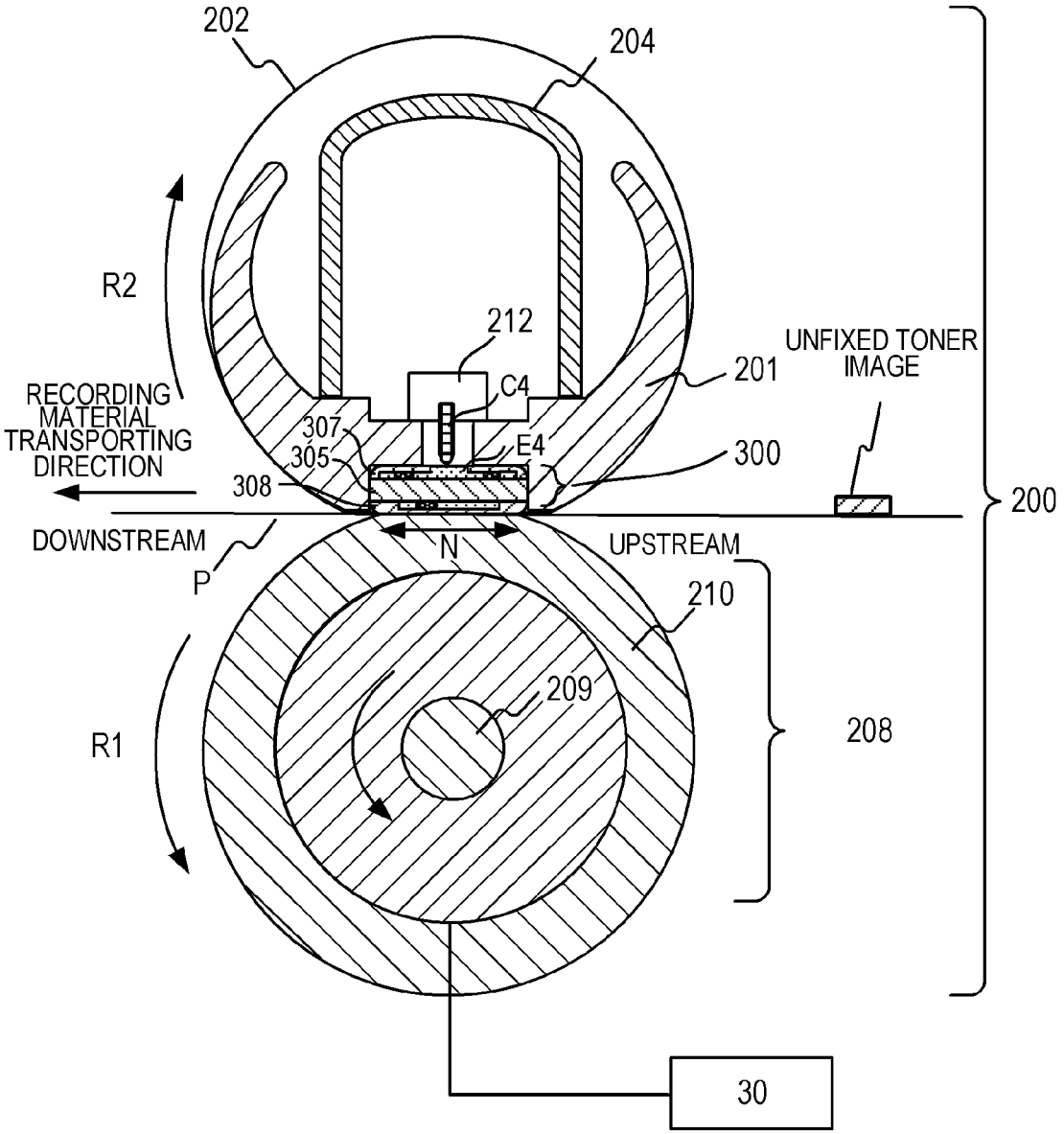
FIG. 2 is a cross-sectional view of an image heating apparatus according to Embodiment 1.

FIG. 2 is a schematic cross-sectional view of the fixing apparatus 200 according to Embodiment 1. The fixing apparatus 200 includes: a fixing film 202, which is an endless belt; a heater 300 which contacts an inner surface of the fixing film 202; a pressure roller 208 which forms a fixing nip portion N with a heater 300 via the fixing film 202; and a metal stay 204.

The fixing film 202 is a flexible cylindrical multilayer heat resistant film, of which base layer can be a 50 to 100 μm thick heat resistant resin (e.g. polyimide), or a 20 to 50 μm thick metal (e.g. stainless steel). On the surface of the fixing film 202, a release layer is disposed to prevent the attachment of toner and to ensure separation from the recording material P. The release layer is a heat resistant resin which excels in releasability, such as a 10 to 50 μm thick tetra fluoroethylene—perfluoro alkyl vinyl ether copolymer (PFA). In the case of a fixing film that is used for an apparatus to form color images, a heat resistant rubber (e.g. silicon rubber), of which thickness is about 100 to 400 μm and thermal conductivity is about 0.2 to 3.0 W/m·K, may be disposed as an elastic layer between the base layer and the release layer so as to improve image quality. In Embodiment 1, in terms of thermal response, image quality and durability, polyimide, of which thickness is 60 μm, is used for the base layer, silicon rubber, of which thickness is 300 μm and thermal conductivity is 1.6 W/m·K, is used for the elastic layer, and PFA, of which thickness is 30 μm, is used for the release layer.

The pressure roller 208 includes a core metal 209 made of iron, aluminum or the like, and an elastic layer 210 made of silicon rubber or the like. The heater 300 is held by a heater holding member 201 made of heat resistant resin and heats the fixing film 202. The heater holding member 201 also includes a guide function which guides the rotation of the fixing film 202. The metal stay 204 receives pressing force from an energizing member (not illustrated), and energizes the heater holding member 201 toward the pressure roller 208. The pressure roller 208 receives power from the motor 30 and rotates in the arrow R1 direction. By the rotation of the pressure roller 208, the fixing film 202 rotates in the arrow R2 direction accordingly. In the fixing nip portion N, the recording material P is held and transported while receiving heat of the fixing film 202, whereby the unfixed toner image on the recording material P is fixed.

The heater 300 is a heater in which heating resistors, which are heating elements disposed on a ceramic substrate 305, heat up by energization. The heater 300 includes a surface protective layer 308 which contacts the inner surface of the fixing film 202, and a surface protective layer 307 which is disposed on the opposite side (hereafter "back surface side") of the side where the surface protective layer 308 is disposed on the substrate 305 (hereafter "sliding surface side"). On the back surface side of the heater 300, electrodes to supply power (electrode E4 is indicated here as a representative) are disposed. C4 is an electric contact that contacts with the electrode E4, and supplies power to the electrode via this electric contact. The heater 300 will be described in detail later. A safety element 212 (e.g. a thermo switch, a thermal fuse), which is activated by overheating of the heater 300 and shuts the power to be supplied to the heater 300 OFF, directly contacts the heater 300 on the back surface side of the heater 300, or indirectly contacts the heater 300 via the heater holding member 201.

3. Configuration of Heater

Figure 3A:
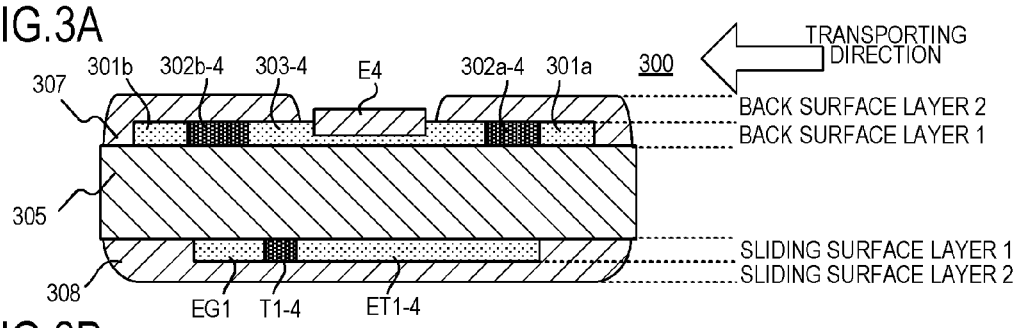
FIG. 3A to FIG. 3C are diagrams depicting a configuration of a heater according to Embodiment 1.
Figure 3B:
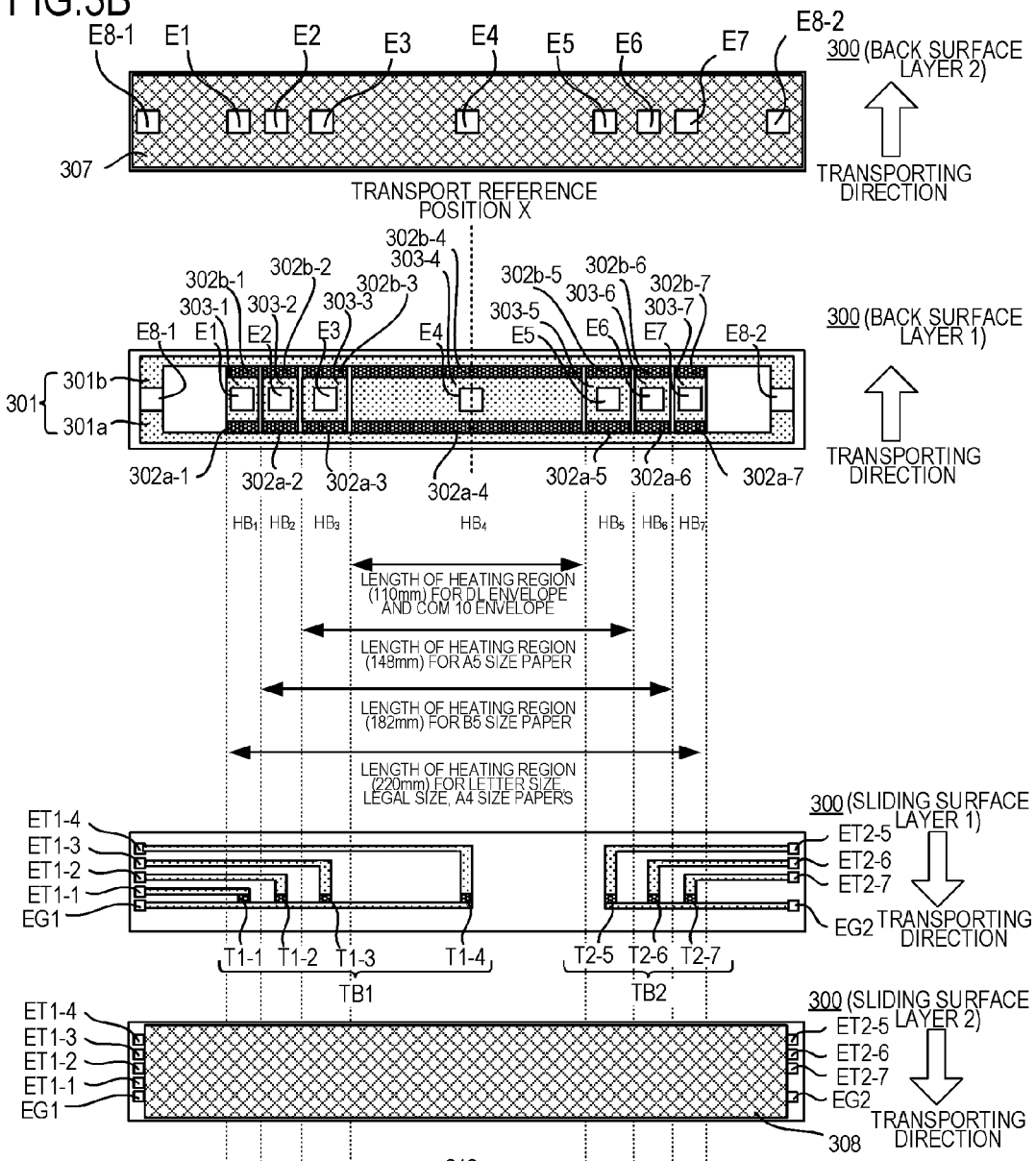
Figure 3C:
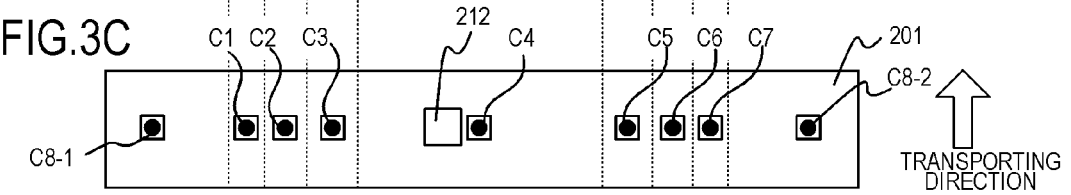

FIG. 3A to FIG. 3C are diagrams depicting the configuration of the heater 300 according to Embodiment 1.

FIG. 3A is a cross-sectional view around the transport reference position X indicated in FIG. 3B. The definition of the transport reference position X is a reference position to transport the recording material P. In Embodiment 1, the recording material P is transported such that the center portion thereof passes through the transport reference position X. In the case of the image forming apparatus according to Embodiment 1, the recording material is transported such that the center portion of the recording material P in the width direction (direction orthogonal to the transporting direction) passes through the transport reference position X. The heater 300 has a five-layer structure constituted of: the substrate 305, two layers on one side (back surface) of the substrate 305 (back surface layers 1 and 2), and two layers on the other side (sliding surface) of the substrate 305 (sliding surface layers 1 and 2).

The heater 300 includes first conductors 301 (301*a*, 301*b*) which are disposed on the substrate 305 on the back surface layer side, along the longer direction of the heater 300. The heater 300 also includes second conductors 303 (303-4 is disposed near the transport reference position X) which are disposed on the substrate 305 in the longer direction of the heater 300, at positions which are different from the first conductors 301 in the shorter direction (direction orthogonal to the longer direction) of the heater 300. The first conductors 301 are divided into conductors 301*a* which are disposed on the upstream side in the transporting direction of the recording material P, and conductors 301*b* which are disposed on the downstream side thereof. Further, the heater 300 includes a heating resistor 302, each of which is disposed between the first conductor 301 and the second conductor 303, and heats up by power that is supplied via the first conductor 301 and the second conductor 303.

The heating resistors 302 are divided into heating resistors 302*a* (302*a*-4 is disposed near the transport reference position X) which are disposed on the upstream side in the transporting direction of the recording material P, and heating resistors 302*b* (302*b*-4 is disposed near the transport reference position X) which are disposed on the downstream side thereof. On the back surface layer 2 of the heater 300, an insulating protective layer 307 (glass in Embodiment 1), that covers the heating resistors 302, the first conductors 301 and the second conductors 303 (303-4 is disposed near the transport reference position X), is disposed so as to avoid electrode portions (E4 is disposed near the transport reference position X).

FIG. 3B is a plan view of each layer of the heater 300. On the back surface layer 1 of the heater 300, a plurality of heating blocks (each heating block is constituted of a set of the first conductor 301, the second conductor 303 and the heating resistor 302) are disposed in the longer direction of the heater 300. The heater 300 of Embodiment 1 includes a total of seven heating blocks $HB_1$ to $HB_7$ in the longer direction of the heater 300.

The heating blocks $HB_1$ to $HB_7$ are constituted of heating resistors 302*a*-1 to 302*a*-7 and the heating resistors 302*b*-1 to 302*b*-7, which are formed to be symmetric with respect to the shorter direction of the heater 300 respectively. The first conductor 301 is constituted of a conductor 301*a* which is connected with the heating resistors (302*a*-1 to 302*a*-7) and the conductor 301*b* which is connected with the heating resistors (302*b*-1 to 302*b*-7). In the same manner, the second conductor 303 is divided into seven (conductors 303-1 to 303-7) in order to support seven heating blocks $HB_1$ to $HB_7$.

In Embodiment 1, the heating block $HB_4$ has a 110 mm width and is used to print DL envelopes and COM 10 envelopes. The heating blocks $HB_3$ to $HB_5$ have a 148 mm width and are used to print A5 size, the heating blocks $HB_2$ to $HB_6$ have a 182 mm width and are used to print B5 size, and the heating blocks $HB_1$ to $HB_7$ have a 220 mm width and are used to print Letter, Legal and A4 size. In this way, the seven heating blocks $HB_1$ to $HB_7$ are divided based on the recording material size supported by the image forming apparatus 100 of Embodiment 1.

Electrodes E1 to E7, E8-1 and E8-2 are used for connecting with electric contacts C1 to C7, C8-1 and C8-2, which are used to supply power from a later mentioned control circuit 400 of the heater 300 respectively. The electrodes E1 to E7 are electrodes used to supply power to the heating blocks $HB_1$ to $HB_7$ via the conductors 303-1 to 303-7 respectively. The electrodes E8-1 and E8-2 are electrodes used to connect to a common electric contact, which is used for supplying power to the seven heating blocks $HB_1$ to $HB_7$ respectively, via the conductor 301*a* and the conductor 301*b*.

In Embodiment 1, the electrodes E8-1 and E8-2 are disposed on both edges in the longer direction respectively, but only the electrode E8-1 may be disposed on one edge (that is, the electrode E8-2 is not disposed), or each electrode may be disposed on the upstream and downstream in the recording material transporting direction respectively.

The surface protective layer 307 on the back surface layer 2 of the heater 300 is formed so that the electrodes E1 to E7, E8-1 and E8-2 are exposed. Thereby the electric contacts C1 to C7, C8-1 and C8-2 can be connected to each electrode from the back surface layer side of the heater 300, and the heater 300 can supply power from the back surface layer side. Power to be supplied to at least one heating block of the heating blocks and power to be supplied to the other heating blocks can be controlled independently.

On the sliding surface layer 1 on the side of the sliding surface (surface that contacts the fixing film) of the heater 300, thermistors T1-1 to T1-4 and thermistors T2-5 to T2-7 are disposed to detect the temperature of each heating block $HB_1$ to $HB_7$ of the heater 300. Each of the thermistors T1-1 to T1-4 and the thermistors T2-5 to T2-7 is made of material having PTC characteristics or NTC characteristics (NTC characteristics in the case of Embodiment 1), which is thinly formed on a substrate. Since each of the heating blocks $HB_1$ to $HB_7$ includes a thermistor, the temperatures of all the heating blocks can be detected by detecting the resistance value of each thermistor.

In order to energize the four thermistors T1-1 to T1-4, conductors ET1-1 to ET1-4 for detecting the resistance values of the thermistors, and a common conductor EG1 of the thermistors, are disposed. By a set of these conductors and the thermistors T1-1 to T1-4, a thermistor block TB1 is formed. In the same manner, in order to energize the three thermistors T2-5 to T2-7, conductors ET2-5 to ET2-7 for detecting the resistance values of the thermistors, and a common conductor EG2 of the thermistors, are disposed. By a set of these conductors and the thermistors T2-5 to T2-7, a thermistor block TB2 is formed.

On the sliding surface layer 2 on the side of the sliding surface (surface that contacts the fixing film) of the heater 300, a surface protective layer 308 having sliding characteristics (glass in the case of Embodiment 1) is disposed. The surface protective layer 308 is formed avoiding both edges of the heater 300 in order to dispose electric contacts for the conductors ET1-1 to ET1-4 and ET2-5 to ET2-7 for detecting the resistance values of the thermistors and the common conductors EG1 and EG2 of the thermistors. The surface protective layer 308 is disposed at least on a region sliding with the film 202 on the surface of the heater 300 facing the film 202, avoiding both edges of the heater 300.

As illustrated in FIG. 3C, holes to connect the electrodes E1 to E7, E8-1 and E8-2 and the electric contacts C1 to C7, C8-1 and C8-2 are disposed on the surface of a heater holding member 201 facing the heater 300. Between the stay 204 and the heater holding member 201, the above mentioned safety element 212 and the electric contacts C1 to C7, C8-1 and C8-2 are disposed. The electric contacts C1 to C7, C8-1 and C8-2, which connect with the electrodes E1 to E7, E8-1 and E8-2, are electrically connected to the respective electrode portions of the heater by such a method as energizing by a spring or by welding. Each electric contact is connected to the later mentioned control circuit 400 of the heater 300 via such conductive materials as a cable and a thin metal plate, which is disposed between the stay 204 and the heater holding member 201. The electric contacts disposed in the conductors ET1-1 to ET1-4 and ET2-5 and ET2-7 for detecting the resistance values of the thermistors, and the electric contacts disposed in the common conductors EG1 and EG2 of the thermistors, are also connected to the later mentioned control circuit 400.

4. Configuration of Heater Control Circuit

Figure 4:
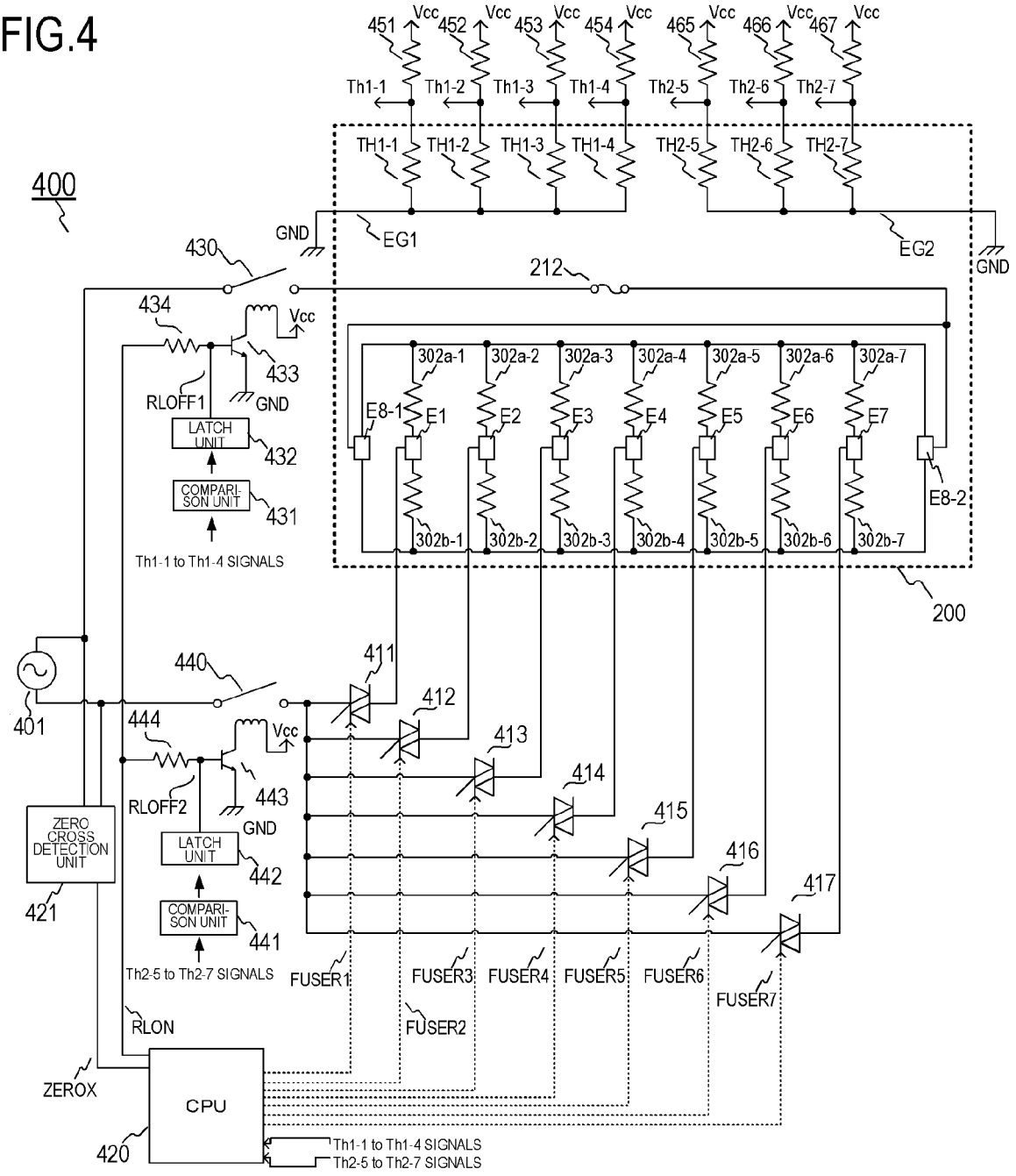
FIG. 4 is a heater control circuit diagram according to Embodiment 1.

FIG. 4 is a circuit diagram of the control circuit 400 of the heater 300 according to Embodiment 1. 401 indicates a commercial AC power supply which is connected to the image forming apparatus 100. Power of the heater 300 is controlled by the ON/OFF of a triac 411 to a triac 417. The triacs 411 to 417 operate in accordance with FUSER 1 to FUSER 7 signals from a CPU 420 respectively. The drive circuits of the triacs 411 to 417 are omitted. The control circuit 400 of the heater 300 has such a circuit configuration that the seven heating blocks $HB_1$ to $HB_7$ can be independently controlled by the seven triacs 411 to 417. A zero cross detection unit 421 is a circuit to detect a zero cross of the AC power supply 401, and outputs a ZEROX signal to the CPU 420. The ZEROX signal is used for detecting the timings to control the phases and wave numbers of the triacs 411 to 417.

The temperature detection method of the heater 300 will be described. For the temperatures detected by the thermistors T1-1 to T1-4 of the thermistor block TB1, divided voltages using the thermistors T1-1 to T1-4 and the resistors 451 to 454 are detected by the CPU 420 as Th1-1 to Th1-4 signals. In the same manner, for the temperatures detected by the thermistors T2-5 to T2-7 of the thermistor block TB2, divided voltages using the thermistors T2-5 to T2-7 and the resistors 465 to 467 are detected by the CPU 420 as the Th2-5 to Th2-7 signals. In the internal processing of the CPU 420, power to be supplied is calculated based on the difference between the currently deleted control target temperature of each heating block (each heating region heated by each heating block), and the temperature of the thermistor. For example, the power to be supplied is calculated by the PI control. Further, the power to be supplied is converted into a corresponding control level of the phase angle (phase control) and the wave number (wave number control), and the triacs 411 to 417 are controlled under these conditions.

A relay 430 and a relay 440 are used to interrupt power to the heater 300 in the case when the heater 300 overheats due to a failure. The circuit operation of the relay 430 and the relay 440 will be described. When a RLON signal becomes High state, the transistor 433 turns ON, current is supplied from the power supply voltage Vcc to the secondary side coil of the relay 430, and the primary side contact of the relay 430 turns ON. When the RLON signal becomes Low state, the transistor 433 turns OFF, the current that is supplied from the power supply voltage Vcc to the secondary side coil of the relay 430 is interrupted, and the primary side contact of the relay 430 turns OFF. In the same manner, when the RLON signal becomes High state, the transistor 443 is turned ON, current is supplied from the power supply voltage Vcc to the secondary side coil of the relay 440, and the primary side contact of the relay 440 turns ON. When the RLON signal becomes Low state, the transistor 443 is turned OFF, the current that is supplied from the power supply voltage Vcc to the secondary side coil of the relay 440 is interrupted, and the primary side contact of the relay 440 turns OFF.

The operation of the safety circuit using the relay 430 and the relay 440 will be described. When a temperature detected by any one of the thermistors Th1-1 to Th1-4 exceeds a predetermined value which is set for each thermistor, a comparison unit 431 activates a latch unit 432, and the latch unit 432 latches an RLOFF1 signal in the Low state. When the RLOFF1 signal becomes the Low state, even if the CPU 420 sets the RLON signal to the High state, the relay 430 can be kept in the OFF state (safe state) since the transistor 443 is kept in the OFF state. In the non-latch state, the latch unit 432 allows the RLOFF1 signal to be outputted in the open state. In the same manner, when a temperature detected by any one of the thermistors Th2-5 to Th2-7 exceeds a predetermined value which is set for each thermistor, a comparison unit 441 activates a latch unit 442, and the latch unit 442 latches an RLOFF2 signal in the Low state. When the RLOFF2 signal becomes the Low state, even if the CPU 420 sets the RLON signal to the High state, the relay 440 can be kept in the OFF state (safe state) since the transistor 433 is kept in the OFF state. In this case as well, in the non-latch state, the latch unit 442 allows the RLOFF2 signal to be outputted in the open state.

5. Image Information

Image data from an external apparatus, such as a host computer, is received by the video controller 120 of the image forming apparatus where image processing is performed. A pixel number of the image forming apparatus of Embodiment 1 is 600 dpi, and the video controller 120 creates a bit map data (image density data for each CMYK color) accordingly. The video controller 120 sends the later mentioned three types of image information acquired by the image processing (image information A, image information B, image information C) to the control unit 113.

The image information A is image information related to the image density in a region of the heating block, excluding the vicinity of the boundary position. The image information B is image information related to the image density in the vicinity of the boundary position of the heating block. The image information C is image information related to the position of the image in the vicinity of the boundary position of the heating block.

Based on the image information A, image information B and image information C, the control unit 113 individually controls power supplied to the seven heating blocks $HB_1$ to $HB_7$ ($HB_i$, i=1 to 7) of the heater 300.

The image information A, the image information B and the image information C will be described in detail.

Image Information A

Figure 5:
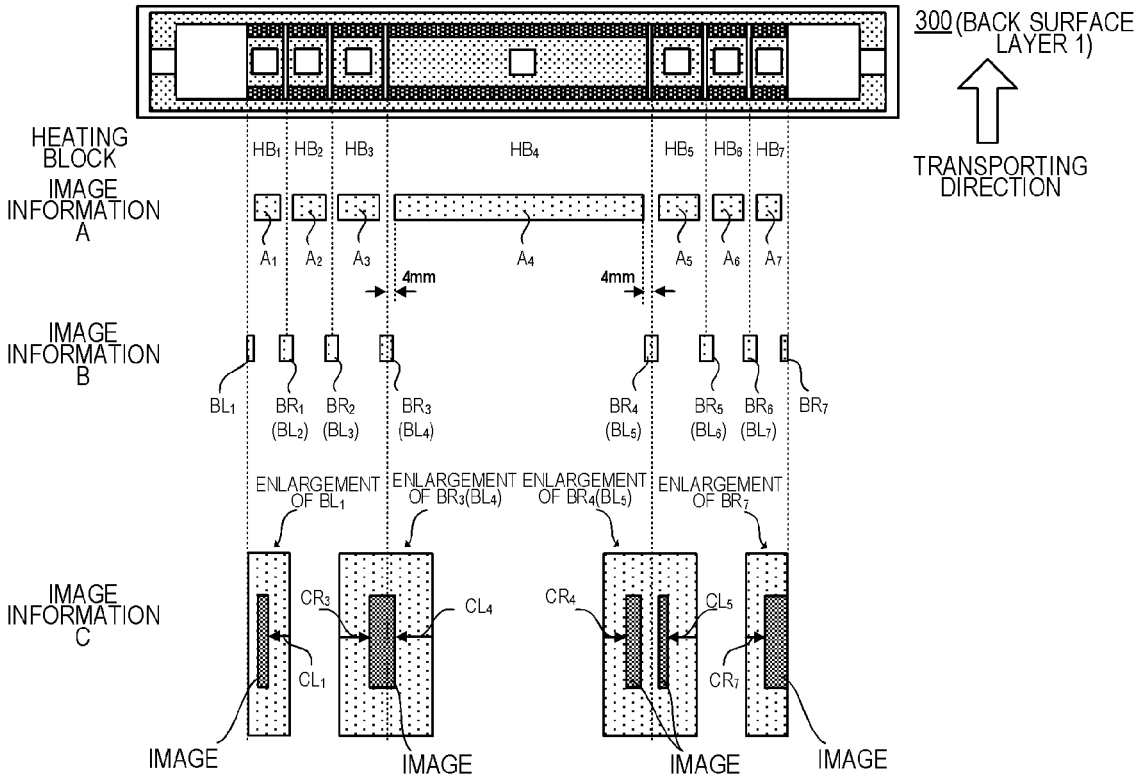
FIG. 5 is a diagram depicting image information according to Embodiment 1.

The video controller 120 analyzes the image density of each color acquired from the CMYK image data received from the host computer using a 1 mm mesh size and calculates the toner amount conversion value for each 1 mm mesh by converting the image density value into a toner amount. As illustrated in FIG. 5, the maximum toner amount conversion value among the toner amount conversion values calculated in each region of $A_1$ to $A_7$ ($A_i$, i=1 to 7), is called image information A. A is a region determined by dividing an image formable region of the recording material (image region constituted of an image portion and non-image portion) in the longer direction so as to correspond to each heating block $HB_i$, and is a region overlapping with each heating block $HB_i$ (non-boundary region), in a range excluding the later mentioned boundary region. A is a region slightly narrower than each heating block $HB_i$ in the longer direction. For example, as illustrated in $A_4$ of FIG. 5, both edges of the region of $A_4$ in the longer direction are 4 mm shorter respectively, compared with the region of $HB_4$. The edges of the regions $A_i$ other than $A_4$ in the longer direction are also 4 mm shorter respectively, compared with the region of $HB_i$. The reason why both edges in the longer direction are 4 mm shorter like this is to consider preventing the influence of a temperature gradient caused by the difference of the control temperature in the vicinity of the boundary position of the heating block $HB_i$.

A method of calculating the maximum toner amount conversion value of the image information A will be described. From the image data converted into CMYK image data, d(C), d(M), d(Y) and d(K), which are the image density of each dot of each C, M, Y and K color are acquired, and the total value thereof d (CMYK) is calculated. This calculation is performed for all the dots in each region ($A_1$ to $A_7$), and these values are converted into the toner amount conversion values. In Embodiment 1, the temperature of the heating block $HB_i$ is constant (unchanged) within one page. Therefore, the image information $A_i$ is the maximum value of the toner amount conversion values in one page calculated within each region.

Here the image information in the video controller 120 is an 8-bit signal, and the image density d(C), d(M), d(Y) and d(K) for each color of the toner is expressed in a range of the minimum density 00h to the maximum density FFh. The total value thereof, d (CMYK), is a 2 byte 8-bit signal. d(CMYK) is a total value of a plurality of toner colors, and the toner amount conversion value may exceed 100%.

Image Information B

As illustrated in FIG. 5, the image information B is information on a vicinity of the boundary position of the heating block $HB_i$, specifically a boundary region that includes a boundary between one heating block HB and an adjacent heating block HB thereof, out of the heating blocks $HB_i$, and that overlaps with these blocks in a predetermined range in the longer direction. This boundary region is disposed to not overlap with the region of $A_i$. The maximum toner amount conversion values calculated in this boundary region are collectively called the image information B. The method of calculating the maximum toner amount conversion values of the image information B is the same as the above mentioned method of calculating the image information A.

As illustrated in FIG. 5, the image information B on the right side of the heating block $HB_i$ is $BR_i$ (i=1 to 7), and the image information B on the left side thereof is $BL_i$ (i=1 to 7). $BL_{i+1}$ and $BR_i$ are exactly the same information, but to simplify description, $BR_i$ is used to indicate the image information B on the right side of the heating block $HB_i$, and $BL_{i+1}$ is used to indicate the image information B on the left side of the heating block $HB_i$.

Image Information C

The image information C indicates the edge positions of the image in the same boundary region as in the case of the image information B, that is, the distance from the non-boundary region to the image portion included in the boundary region in the longer direction. Out of a plurality of boundary regions that are formed corresponding to a plurality of heating blocks HB, the boundary regions formed on the edges in the longer direction ($BL_1$, $BR_7$) have one adjacent non-boundary region respectively ($A_1$, $A_7$) where there is one image information C. In the other boundary regions ($BL_2$ to $BL_7$, $BR_1$ to $BR_6$), a non-image region adjoins on one side and the other side in the longer direction respectively, hence there are two image information C. In FIG. 5, $BL_1$, $BR_3$ ($BL_4$), $BR_4$ ($BL_5$) and $BR_7$ are enlarged and indicated as examples to describe the image information C.

As illustrated in FIG. 5, the video controller 120 calculates the image distance, such as the image distance from the right side boundary of $BL_1$ is $CL_1$, the image distance from the left side boundary of $BR_3$ is $CR_3$, the image distance from the left side boundary of $BL_4$ is $CL_4$, and the image distance from the boundary of $BR_7$ is $CR_7$. The video controller 120 also calculates the image distance as the image information C for the other regions that are not illustrated in FIG. 5 as well, using the same method. If a plurality of images exist in the region, the distance of an image closest to the boundary is calculated as the image information C, as indicated in $CR_4$ and $CL_5$ in FIG. 5.

In Embodiment 1, the temperature of the heating block HB, is constant within the page. Therefore, the image information $CR_i$ and the image information $CL_i$ indicate the minimum distance in the page.

6. Method of Determining Control Temperature

Figure 6:
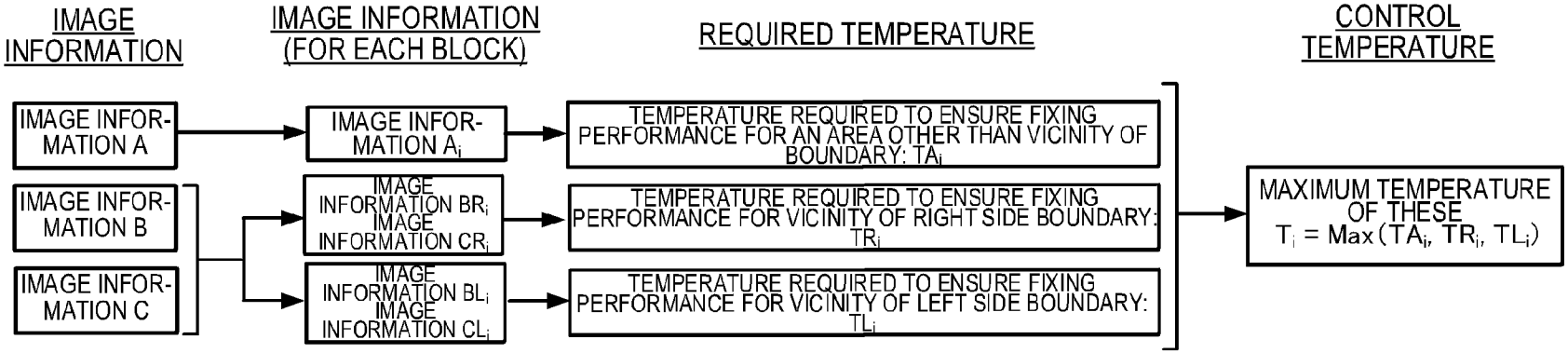
FIG. 6 is a conceptual diagram depicting a control temperature determination method according to Embodiment 1.

The method of the control unit 113, determining the control temperature $T_i$ (i=1 to 7) of the seven heating blocks $HB_i$ based on the image information A, image information B and image information C, will be described. FIG. 6 is a conceptual diagram of the process of determining the control temperature $T_i$. For the control temperature $T_i$, the maximum temperature of three types of required temperatures ($TA_i$, $TR_i$, $TL_i$) is set.

Method of Determining $TA_i$ $TA_i$ is a temperature (second temperature) that is required to ensure fixing performance is an area other than the vicinity of the boundary of the heating block $HB_i$. As illustrated in FIG. 6, $TA_i$ is determined from the image information $A_i$.

Figure 7A:
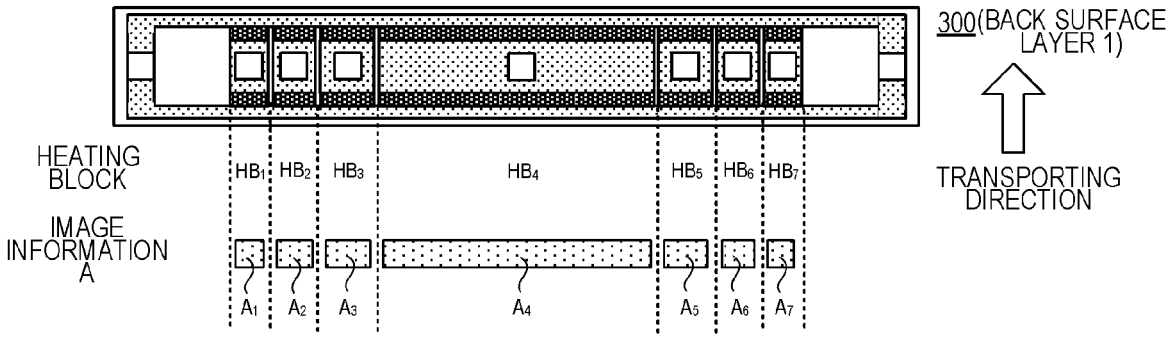
FIG. 7A and FIG. 7B are diagrams depicting a method of determining $TA_1$ according to Embodiment 1.
Figure 7B:
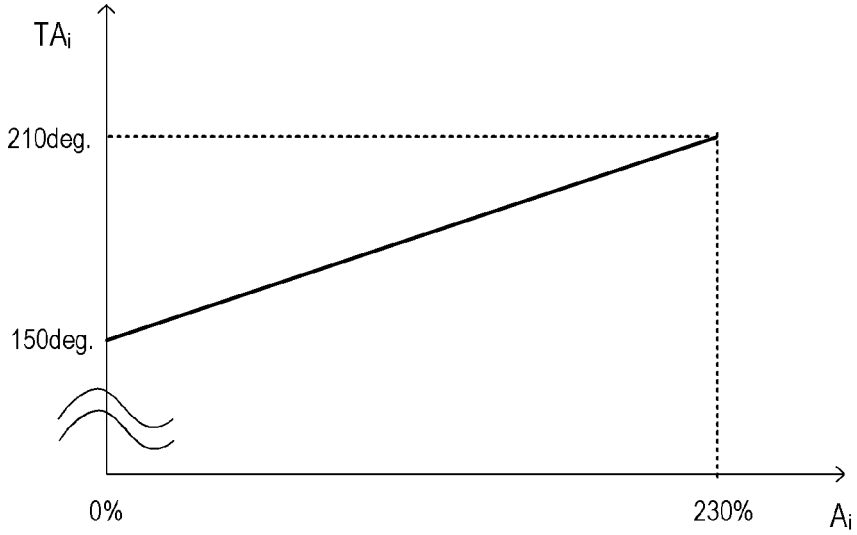

$TA_i$ will be described with reference to FIGS. 7A and 7B. FIG. 7A is a diagram of a portion related to the image information A extracted from FIG. 5. FIG. 7B is a graph depicting the relationship between the image information $A_i$ and $TA_i$. The image information $A_i$ is a maximum toner amount conversion value in the regions indicated in FIG. 7A, and in Embodiment 1, the temperature must be linearly increased as this value is greater. FIG. 7B indicates this state.

In the image forming apparatus of Embodiment 1, the toner amount on the recording material P is adjusted so that 1.15 mg/cm$^2$ (corresponds to 230% in the case of the toner amount conversion value) is the upper limit. In Embodiment 1, the heat amount required for melting the toner increases as the image density on the recording material P is higher and the toner amount is higher, hence the control temperature must be increased more. As indicated in FIG. 7B, according to Embodiment 1, the temperature of $HB_i$ must be 210 deg. if $A_i$=230% and be 180 deg. if $A_i$=115%.

Method of Determining $TR_i$, $TL_i$ $TR_i$ is a temperature required to ensure the fixing performance in the vicinity of the right side boundary of the heating block HB, (first temperature). As indicated in FIG. 6, $TR_i$ is determined based on the image information $BR_i$ and the image information $CR_i$.

Figures 8A, 8B, 8C:
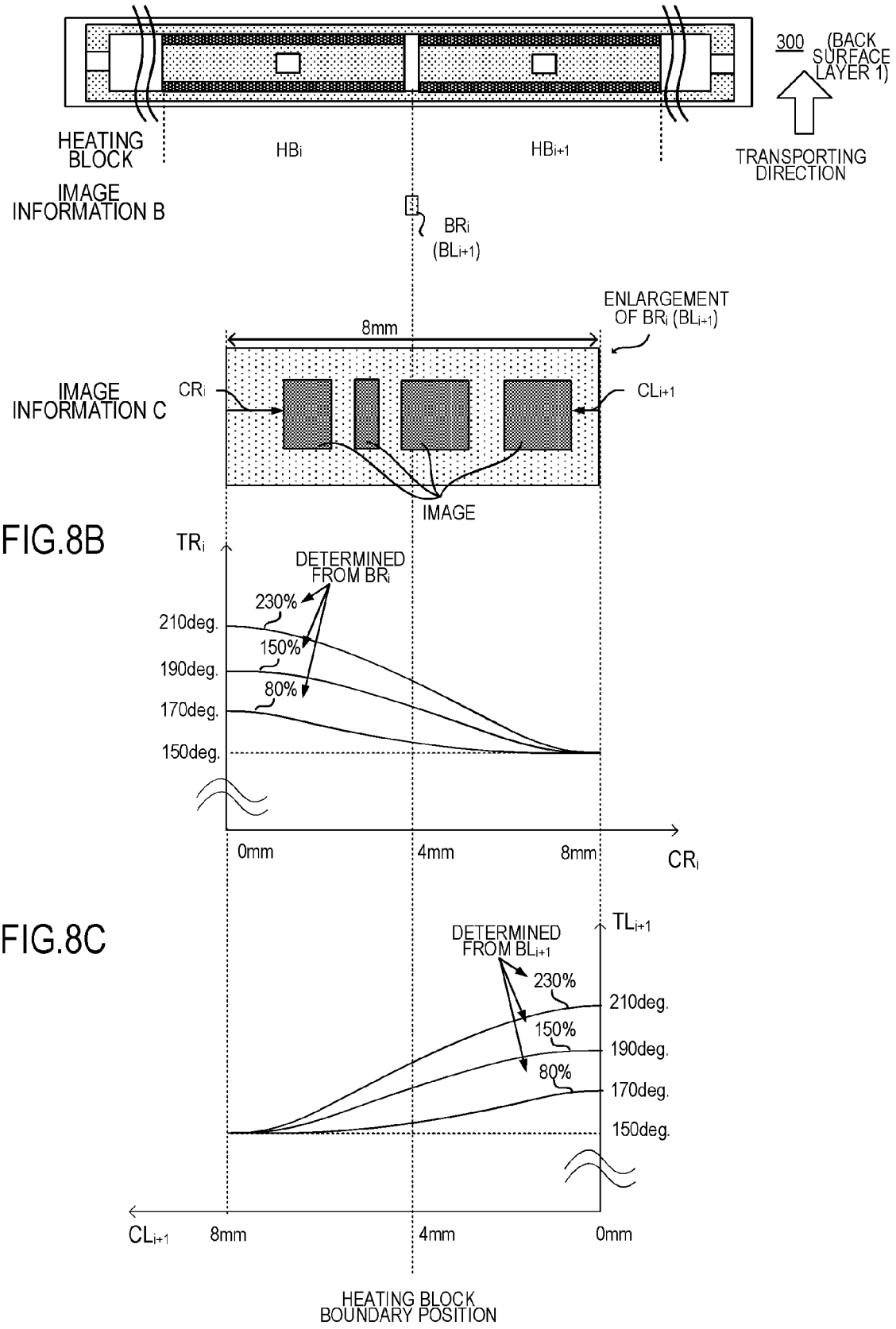
FIG. 8A to FIG. 8C are diagrams depicting a method of determining $TR_1$ and $TL_1$ according to Embodiment 1.

$TR_i$ will be described with reference to FIGS. 8A to 8C. FIG. 8A is a diagram for describing the image information B and the image information C, which are image information on the vicinity of the boundary of the heating block HB, and the heating block $HB_{i+1}$. The contents of the image information B and the image information C are as described in FIG. 5. The image information C is image information in a region that is 8 mm in the longer direction, but for description, the image information C is enlarged in the longer direction here. In FIG. 8A, there are four images, but the distance of an image that is closes to the boundary portion is regarded as the image information C, hence the image distance from the left boundary portion of $BR_i$ is $CR_i$, and the image distance from the right boundary portion of $BL_{1+1}$ (BR) is $CL_{i+1}$.

FIG. 8B is a graph depicting the image information $BR_i$, and the relationship between the image information $CR_i$ and $TR_i$. The 8 mm of the abscissa of the graph and the 8 mm of the image information C in the longer direction illustrated in FIG. 8A are expressed with a same scale factor. The image information $BR_i$ is the maximum toner amount conversion value in the region indicated in FIG. 8A, and in Embodiment 1, the temperature of $TR_i$ must be higher as this value $BR_i$ is greater. FIG. 8B is a case when $BR_i$=230%, 150% and 80%, and if $CR_i$=0 mm, that is, if the image exists to the left edge of the region of $BR_i$, $TR_i$ becomes 210 deg., 190 deg. and 170 deg. respectively. In FIG. 8B, only three levels of $BR_i$ are indicated, but actually a number of $BR_i$ values that are required (230 levels in 1% intervals in Embodiment 1) is stored as table values.

The temperature $TR_i$ can be decreased as the image information $CR_i$, which is a value on the abscissa in FIG. 8B, increases (as the image is more distant from the region of the heating block $HB_i$). This is because in the heating block $HB_{i+1}$, which is an adjacent zone, the temperature $TL_{i+1}$, which is required to ensure the fixing performance in the vicinity of the left side boundary, is set. FIG. 8C is a graph depicting the image information $BL_{i+1}$ and the relationship between the image information $CL_{i+1}$ and $TL_{i+1}$, and has a form that is symmetrical with the graph in FIG. 8B with respect to the boundary between the heating blocks $HB_i$ and $HB_{i+1}$. The graph in FIG. 8B is determined considering the heat amount supplied from the adjacent heating blocks as well. For the left edge of $HB_1$ and the right edge of $HB_7$, which have no adjacent heating blocks, table values higher than the temperature indicated in FIG. 8B are set.

As described above, the control unit 113 determines $TR_i$ according to the relationship in FIG. 8B, based on the image information $BR_i$ and the image information $CR_i$, $TL_i$, which is a first temperature that is different from $TR_i$, is also determined based on the image information $BL_i$ and the image information $CL_i$.

Flow of Determining Control Temperature

Figure 9:
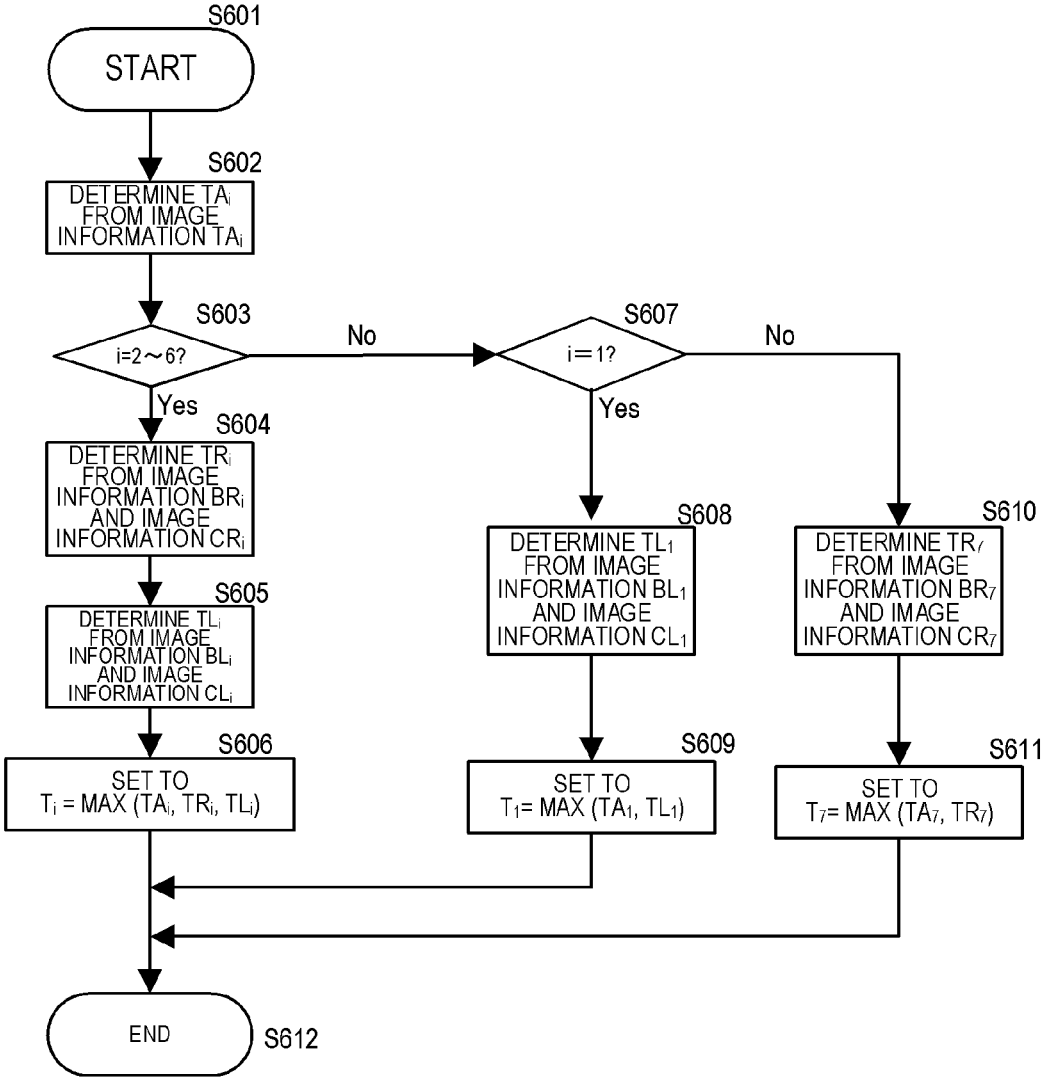
FIG. 9 is a flow chart to determine the control temperature according to Embodiment 1.

FIG. 9 is a flow to determine the control temperature $T_i$ of the heating block $HB_i$. When the control unit 113 receives image information from the video controller 120 and starts calculation of the control temperature (S601), $TA_i$ is determined (acquired) from the image information $A_i$ in S602 using the relationship in FIG. 7B as a first step. If the heating blocks for which the control temperature is determined are $HB_2$ to $HB_6$ (Yes in S603), $TR_i$ is determined (acquired) from the image information $BR_i$ and the image information $CR_i$ in S604 using the relationship in FIG. 8B as a first step. In the same manner, $TL_i$ is determined (acquired) from the image information $BL_i$ and the image information $CL_i$ in S605 as the first step. As the second step, $TA_i$, $TR_i$ and $TL_i$ are compared in S606, and the highest temperature is determined as the control temperature $T_i$ of $HB_i$.

If the heating block for which the control temperature is determined is $HB_1$ (Yes in S603, Yes in S607), $TL_1$ is determined (acquired) from the image information $BL_1$ and the image information $CL_1$ in S608 using the relationship in FIG. 8C as the first step. As the second step, $TA_1$ and $TL_1$ are compared in S609, and the higher temperature is determined as the control temperature $T_1$ of $HB_1$. In the case where the heating block is not $HB_1$ (No in S607) as well, flow is the same, hence description thereof is omitted. By the above flow, the control temperatures $T_1$ to $T_7$ of $HB_1$ to $HB_7$ are all determined, and the control unit 113 ends the calculation (S612).

7. Effect of Embodiment 1

Figure 10:
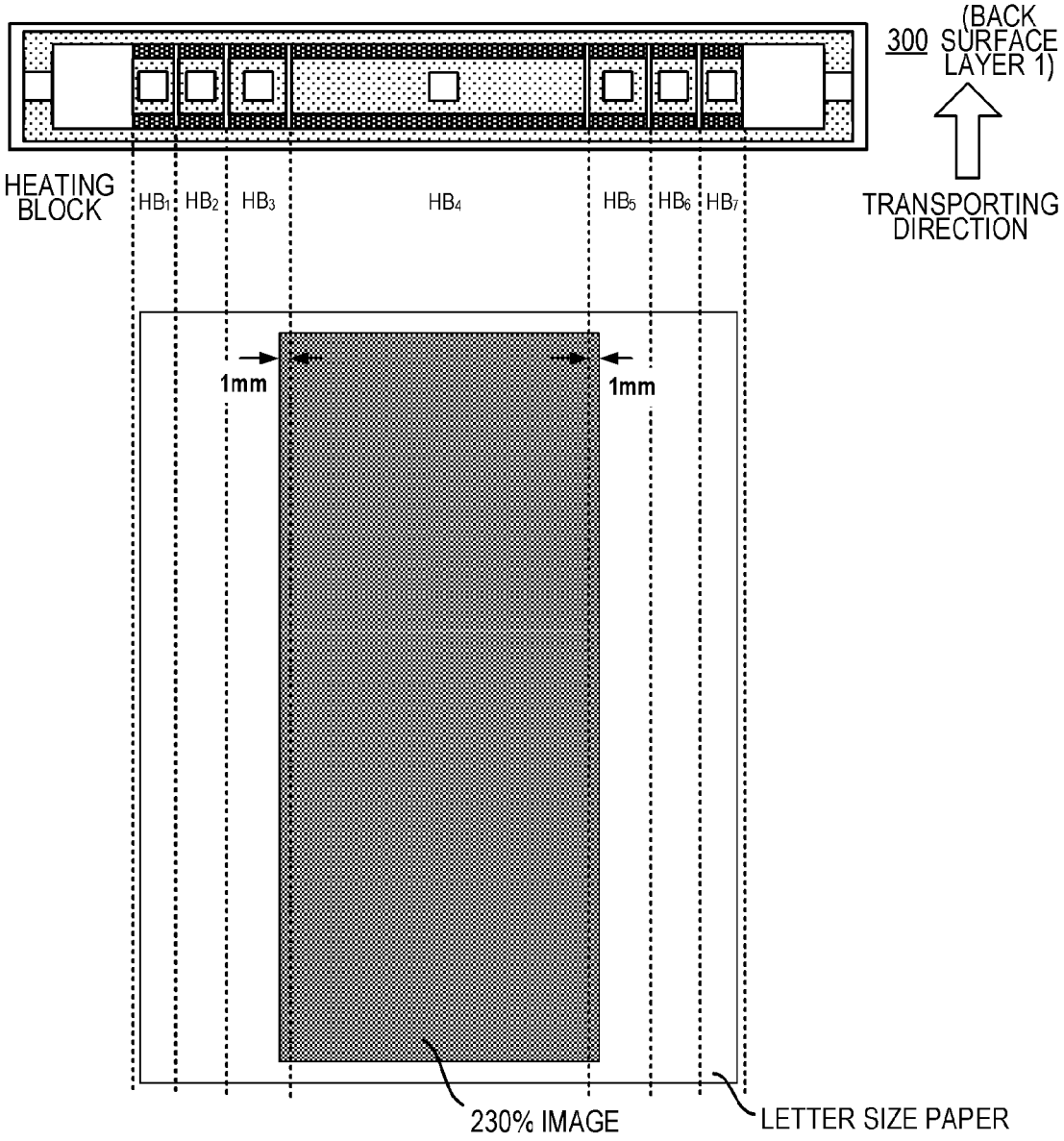
FIG. 10 is a diagram depicting an image when the power is measured according to Embodiment 1.

Power consumption was compared between Embodiment 1 and Comparative Embodiment 1. The power consumption was measured under the following conditions, using the image forming apparatus 100. The process speed of the image forming apparatus 100 according to Embodiment 1 is 210 mm/s, and in the case of Letter size, 40 pages per minute (ppm) of throughput can be implemented in continuous printing. The recording material used here is multipurpose paper (basis weight: 75 g/m$^2$, Letter size) made by HP. The image is a 230% image as illustrated in FIG. 10, which is drawn extending from the region of $HB_4$ by 1 mm on both sides in the longer direction, and is uniformly drawn in the transporting direction excluding a 5 mm margin in the front end and the rear end respectively. By comparing the average power consumed by the fixing apparatus 200 when 100 sheets are continuously printed under the above conditions, the power saving effect of Embodiment 1 with respect to Comparative Embodiment 1 was measured. Table 1 indicates the comparison result.

TABLE 1

| | $T_3$ | $T_4$ | $T_5$ | Average power consumption |
|---|---|---|---|---|
| Comparative Embodiment 1 | 210 deg. | 210 deg. | 210 deg. | 587 W |
| Embodiment 1 | 180 deg. | 210 deg. | 180 deg. | 560 W |

Comparative Embodiment 1 is a case where the present invention is not used, and $HB_3$ and $HB_5$ are recognized as image portions. Therefore, the control temperature is set to a same temperature as $HB_4$ (210 deg.). In Embodiment 1, on the other hand, the temperature of the $HB_3$ is set such that the control temperature be 180 deg. because of the image information $BR_3$=230%, and $CR_3$=3 mm and the above relationship in FIG. 8B. For $HB_5$ as well, the control temperature is set to 180 deg. In Embodiment 1, the temperatures of the non-image heating portions, that is, the temperatures of $HB_1$, $HB_2$, $HB_6$ and $HB_7$ are set to 150 deg. Further, in Embodiment 1, the temperature of the heating block $HB_i$ is constant within one page. Hence the image information $A_i$ and the image information $B_i$ are the maximum values of the toner amount conversion values within one page calculated in each region, and the image information $CR_i$ and the image information $CL_i$ are the minimum distances within the one page.

As a result of measuring power under the above conditions, the average power consumed by the fixing apparatus 200 of Embodiment 1 was 560 W. In the case of Comparative Embodiment 1, on the other hand, the average power was 587 W. Compared with Comparative Embodiment 1, Embodiment 1 can decrease the control temperatures $HB_3$ and $HB_5$, therefore a 27 W of power saving effect is implemented.

As described above, in the image forming apparatus that adjusts the heating conditions of a plurality of heating blocks disposed in the longer direction in accordance with the image information, the power saving effect can be improved if Embodiment 1 is applied.

In Embodiment 1, the seven heating blocks are divided based on the recording material sizes supported by the imaging forming apparatus 100 but may be divided by a different method. A number of heating blocks is seven in the longer direction according to the above description, but a number of heating blocks may be any number that is at least two in the longer direction to apply the setting according to Embodiment 1.

In Embodiment 1, the temperature of the heating block $HB_i$ is constant within one page, but the control temperature may be changed if necessary, by updating the image information within one page if necessary. The image information is acquired in units of a 1 mm mesh size, but the mesh size may be changed if necessary.

Figure 11:
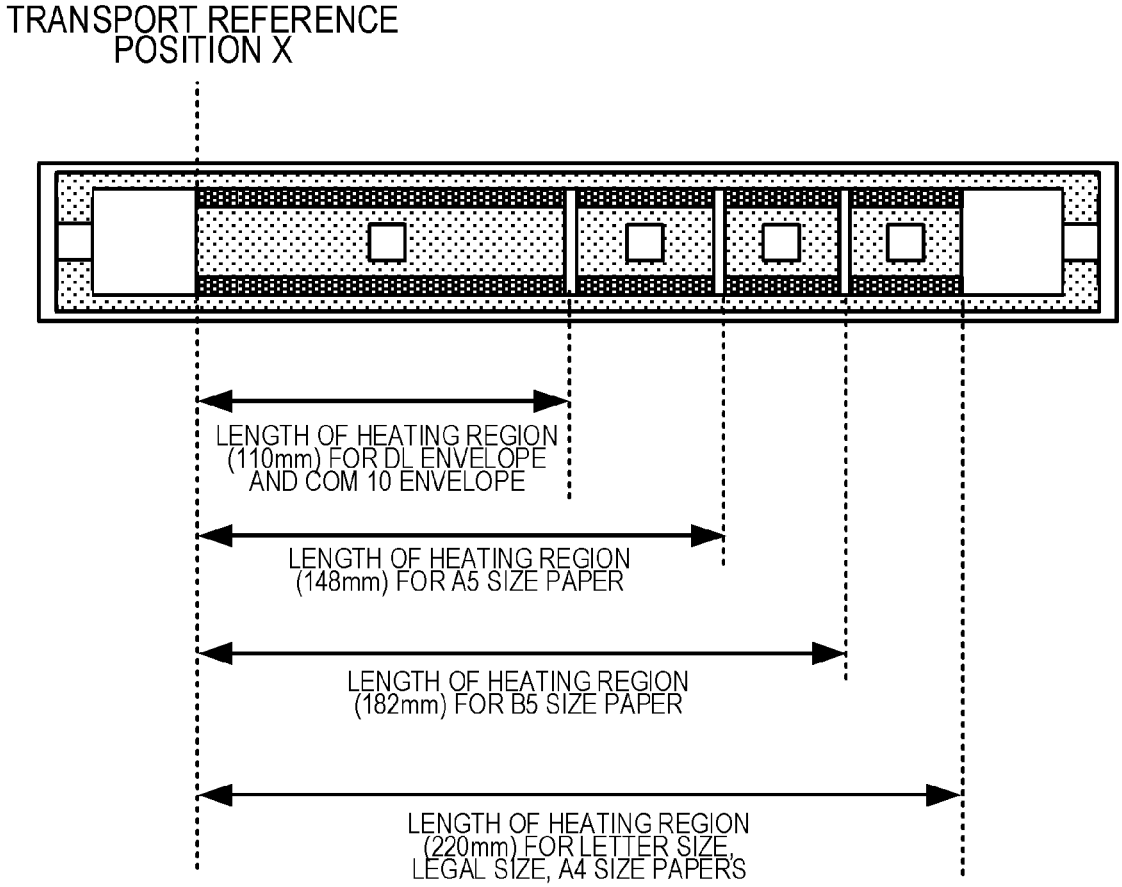
FIG. 11 is a diagram depicting another mode of the heater configuration according to Embodiment 1.

In Embodiment 1, the recording material P is set so that the center portion of the recording material P passes through the transport reference position X during transporting, but as illustrated in FIG. 11, the recording material P may be set so that one edge of the recording material P passes through the transport reference position X.

Embodiment 2

The configurations of an image forming apparatus, an image heating apparatus, a heater, and a heater control circuit are the same as Embodiment 1, hence description thereof will be omitted. In Embodiment 2, the control temperature $T_i$ of the heating block $HB_i$ is determined by a method different from Embodiment 1. In Embodiment 1, the control temperature $T_i$ of each heating block $HB_i$ is determined using the image information A, the image information B, and the image information C. By this method, however, when more detailed information is acquired (e.g. a 1 mm mesh of Embodiment 1 is further divided), processing by the video controller 120 may not keep up since the information volume of the image is too large.

Image Information and Control Temperature of Embodiment 2

Figure 12:
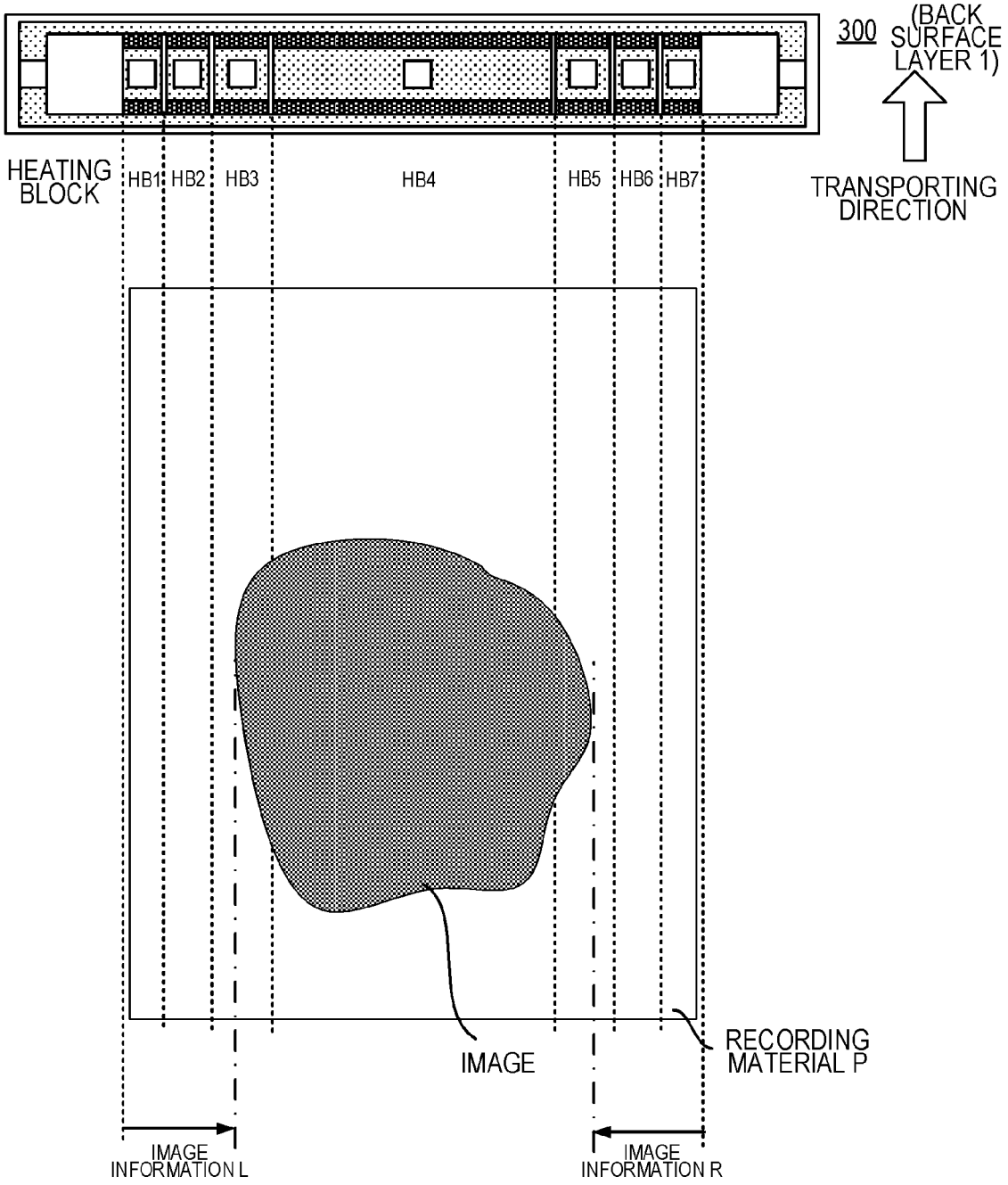
FIG. 12 is a diagram depicting image information according to Embodiment 2.

In many cases, an image that is normally outputted is an image that is drawn within a predetermined range of the recording material P, as illustrated in FIG. 12. In FIG. 12, $HB_3$, $HB_4$ and $HB_5$, which are disposed at the center portion in the longer direction, are image heating portions where a heating region, of which heating range overlaps with the image of the recording material, is heated. $HB_1$, $HB_2$, $HB_6$ and $HB_7$, which are disposed on the edges in the longer direction, are non-image heating portions where a heating region, of which heating range does not overlap with the image of the recording material, is heated.

Further, in many cases, an image that is normally outputted is not an image where such image attributes as text and graphics do not coexist within one page. In this case, the maximum toner amount conversion value in each heating block is not so different from each other, hence the control temperature difference among the image heating portions is not so large. Therefore, a better power saving effect may be expected in some cases by decreasing the control temperature of the non-image heating portions, rather than a power saving effect implemented by determining the control temperatures of the image heating portions using the image information A, the image information B, and the image information C.

Therefore in Embodiment 2, in order to determine the control temperatures of non-image heating portions more accurately, the resolution of the image distance of the image information C related to the control temperatures is made even finer. The resolution is 1 mm in Embodiment 1 but is 0.1 mm in Embodiment 2. Accordingly, the information amount to determine the control temperatures of the image heating portions is decreased as follows. In Embodiment 1, the image information A is a 2 byte 8-bit signal, but in Embodiment 2, the image information A is a 1 byte 3-bit signal, and the maximum toner amount conversion value is expressed in 16 levels, as indicated in Table 2. The image information B and the image information C to determine the control temperatures of the image heating portions do not exist, and the control temperatures of the image heating portions are determined by the image information A alone.

TABLE 2

| Level | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| Maximum toner amount conversion value | 0% | 15% | 30% | 45% | 60% | 75% | 90% | 105% | 120% | 135% | 150% | 165% | 180% | 195% | 210% | 230% |

As illustrated in FIG. 12, in Embodiment 2, the image information R and the image information L are used. The image information R is a distance from the right edge of the heating block $HB_7$ located as the right end position of the image in one page, and the image information L is a distance from the left edge of the heating block $HB_1$ located at the left end position of the image in the one page. As illustrated in FIG. 12, in Embodiment 2, an image in a region from the heating block $HB_3$ to the heating block $HB_5$ is drawn.

Figure 13A:
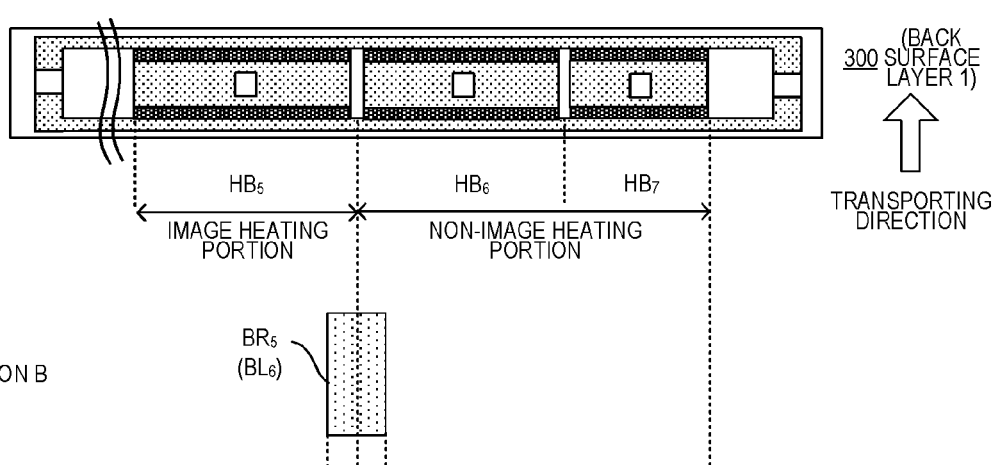
FIG. 13A to FIG. 13C are diagrams depicting details of the image information R according to Embodiment 2.
Figure 13B:
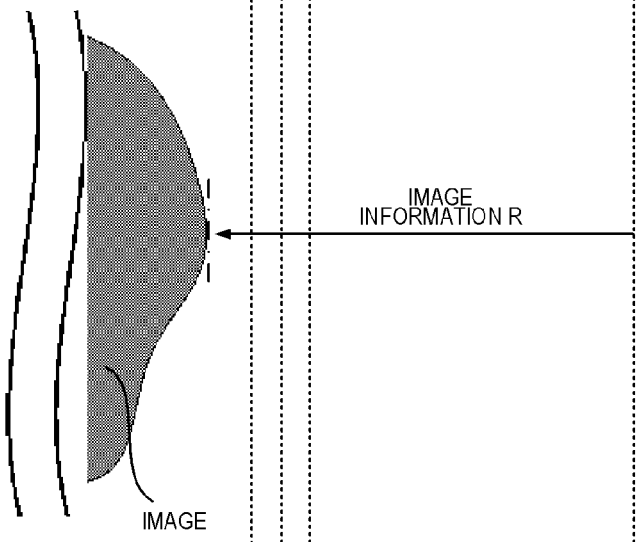

FIGS. 13A to 13B are diagrams depicting determination of the control temperatures of the heating blocks $HB_6$ and $HB_7$ based on the image information R using the image in FIG. 12 as an example. Further, the control temperatures of the heating blocks $HB_1$ and $HB_2$ are determined based on the image information L. The description of the determination of the control temperatures based on the image information L, however, will be omitted, since the procedure is the same as the case of the image information R.

Figure 13C:
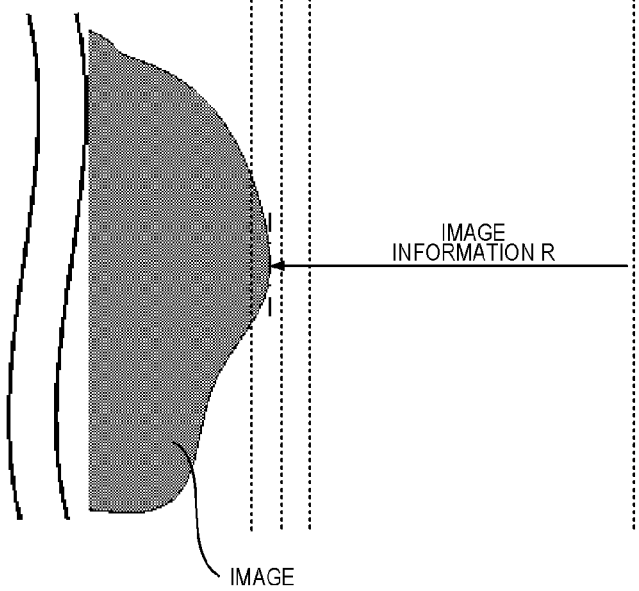

FIG. 13A is a diagram extracting a portion related to the image information B from FIG. 5. FIG. 13B and FIG. 13C are enlarged views of the portion near the right edge of the image in FIG. 12. FIG. 13B is a case when the right edge of the image, that is, the image information R, is not in a region of $BR_5$ which is in the vicinity of the boundary position between $HB_5$ and $HB_6$, but inside the image heating portion $HB_5$ (Case 1). FIG. 13C is a case when the right edge of the image, that is, the image information R, is in a region of $BR_5$ which is in the vicinity of the boundary position between $HB_5$ and $HB_6$ (Case 2).

Figure 14:
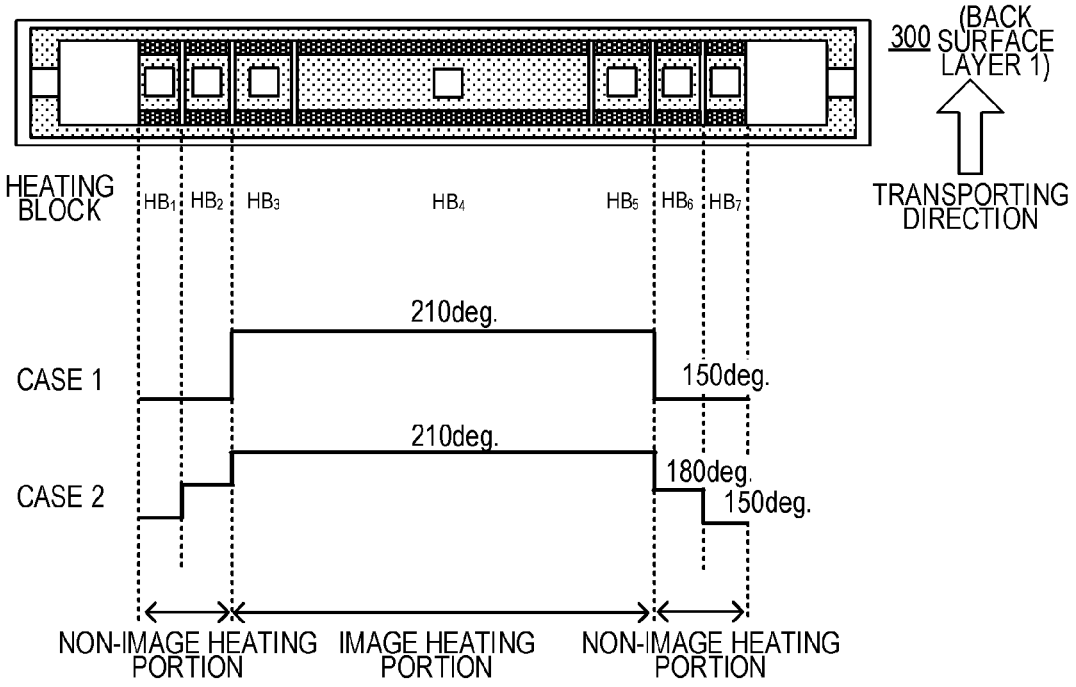
FIG. 14 is a diagram depicting the control temperature according to Embodiment 2.

In Case 1 in FIG. 13B, the control temperature 150 deg. is set for the heating blocks $HB_6$ and $HB_7$ as the non-image portion temperatures. The temperature of the heating block $HB_6$ can be decreased because the image is not in the vicinity of the boundary position between $HB_5$ and $HB_6$, and the fixing performance in the right edge of the image can be ensured even if the temperature of $HB_6$ is not high. The temperatures of the heating blocks $HB_3$, $HB_4$ and $HB_5$, which are image heating portions, are determined by the relationship in FIG. 7B based on the image information $A_3$, $A_4$ and $A_5$, just like Embodiment 1. However, as mentioned above, the signal of the image information A has been compressed more than Embodiment 1, as mentioned above. Therefore, the control temperature of Case 1 has the distribution indicated in Case 1 in FIG. 14.

In Case 2 in FIG. 13C, the control temperature 150 deg. is set for the heating block $HB_7$ as the non-image portion temperature, which is the same as Case 1. The temperature of the heating block $HB_6$, on the other hand, is determined by the relationship in FIG. 7B based on the image information $BL_6$ and the image information $CL_6$, just like Embodiment 1, in order to ensure the fixing performance in the right edge of the image in the vicinity of the boundary position with $HB_5$. The resolution of the distance of the image $CR_i$, however, is finer than Embodiment 1, as mentioned above. The control temperature of Case 2 has the distribution indicated in Case 2 in FIG. 14. In Case 2, the control temperatures of $HB_2$ and $HB_6$ are higher than Case 1, in order to ensure the fixing performance of the image in the vicinity of the boundary position with $HB_3$ or $HB_6$.

Effect of Embodiment 2

Figure 15:
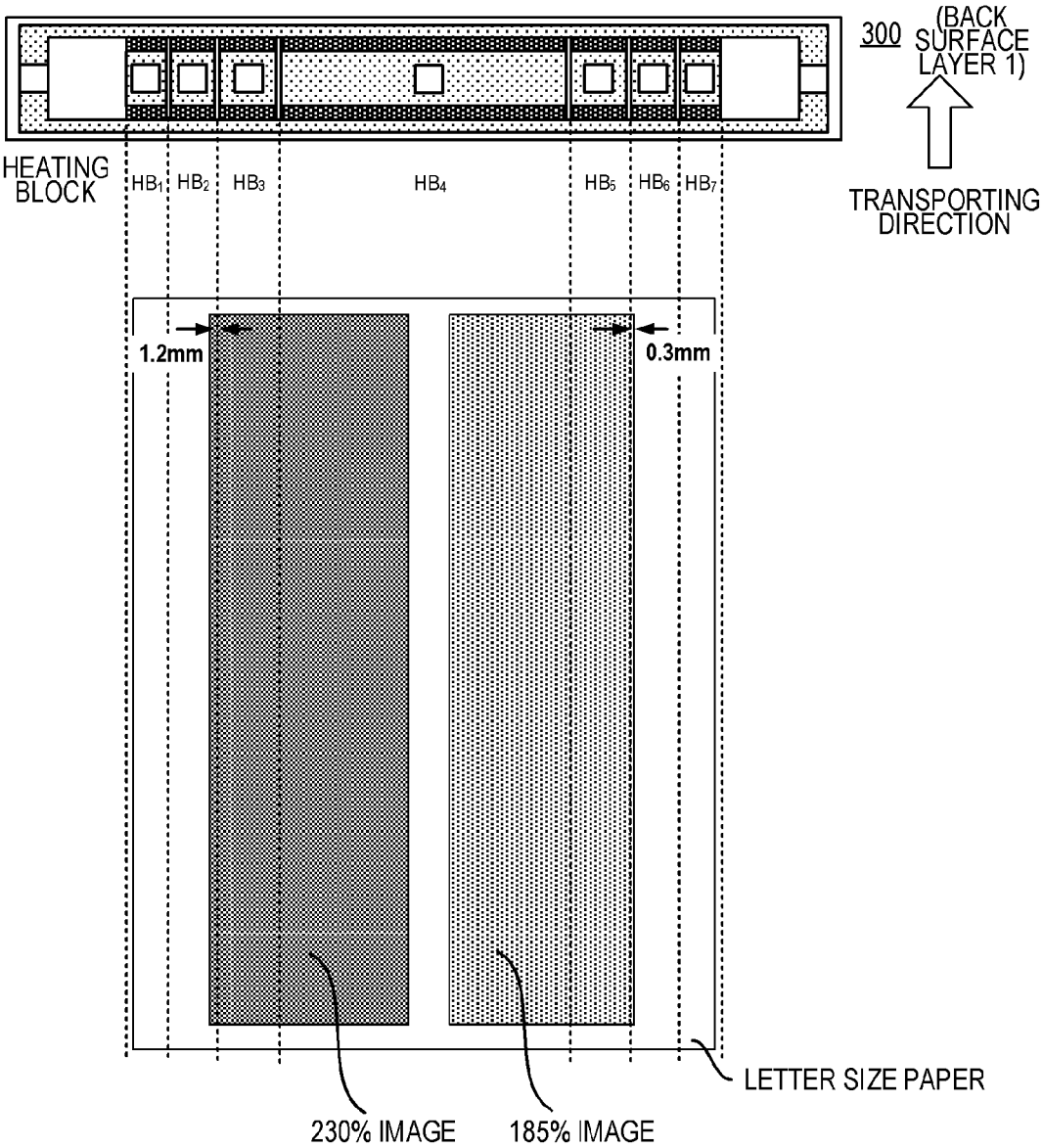
FIG. 15 is a diagram depicting an image when power is measured according to Embodiment 2.

Power consumption was compared among Embodiment 2, Comparative Embodiment 2, and Embodiment 1. The power consumption was measured under the same conditions as Embodiment 1, using the image forming apparatus 100. The image of Embodiment 2 is a 230% image and a 185% image, as illustrated in FIG. 15, which are uniformly drawn in the transporting direction, excluding 5 mm margins in the front end and the rear end. By comparing the average power consumed by the fixing apparatus 200 when 100 sheets are continuously printed under the above conditions, the power saving effect of Embodiment 2 with respect to Comparative Embodiment 2 and Embodiment 1 was measured. Table 3 indicates the comparison result.

TABLE 3

| | $T_1$ | $T_2$ | $T_3$ | $T_4$ | $T_5$ | $T_6$ | $T_7$ | Average power consumption |
|---|---|---|---|---|---|---|---|---|
| Comparative Embodiment 2 | 150 deg. | 210 deg. | 210 deg. | 210 deg. | 199 deg. | 199 deg. | 150 deg. | 632 W |
| Embodiment 1 | 150 deg. | 198 deg. | 210 deg. | 210 deg. | 199 deg. | 186 deg. | 150 deg. | 616 W |
| Embodiment 2 | 150 deg. | 191 deg. | 210 deg. | 210 deg. | 201 deg. | 177 deg. | 150 deg. | 609 W |

Comparative Embodiment 2 is a case where the present invention is not used, and $HB_2$ and $HB_6$ are recognized as image portions. Therefore, the control temperature of $HB_2$ is set to a same temperature as $HB_3$ (210 deg.), and the control temperature of $HB_6$ is set to a same temperature as $HB_5$ (199 deg.).

Figure 16A:
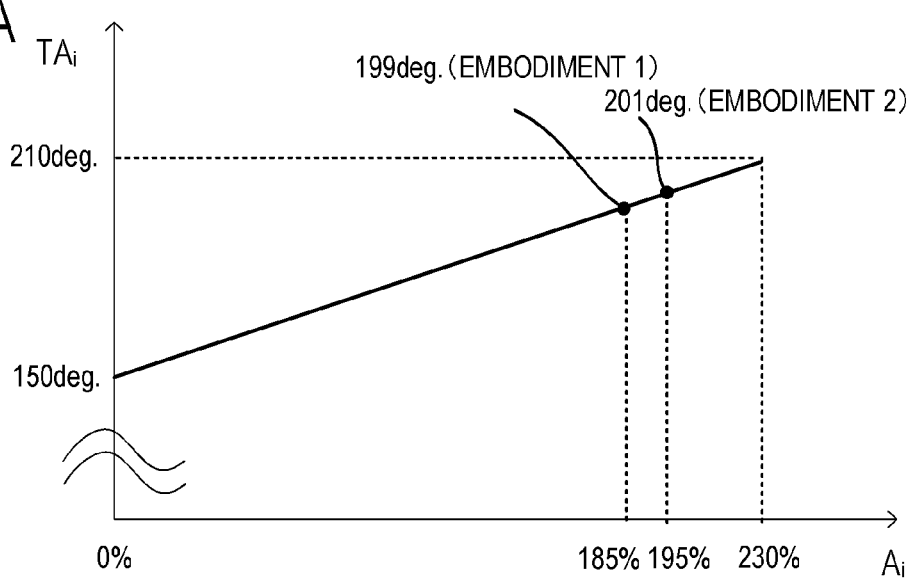
FIG. 16A and FIG. 16B are graphs depicting a control temperature determination method according to Embodiment 2.

Just like the relationship in FIG. 7B, FIG. 16A indicates that the control temperature is determined based on the image information $A_i$ in the image heating portions of Embodiment 1 and Embodiment 2. In Embodiment 1, $A_5$=185% and the control temperature of $HB_5$ is set to 199 deg., as indicated in FIG. 16A. In Embodiment 2, on the other hand, data is in 16 levels, as indicated in Table 2 above, hence $A_5$=195% and the control temperature of $HB_5$ is set to 201 deg., as indicated in FIG. 16A.

Figure 16B:
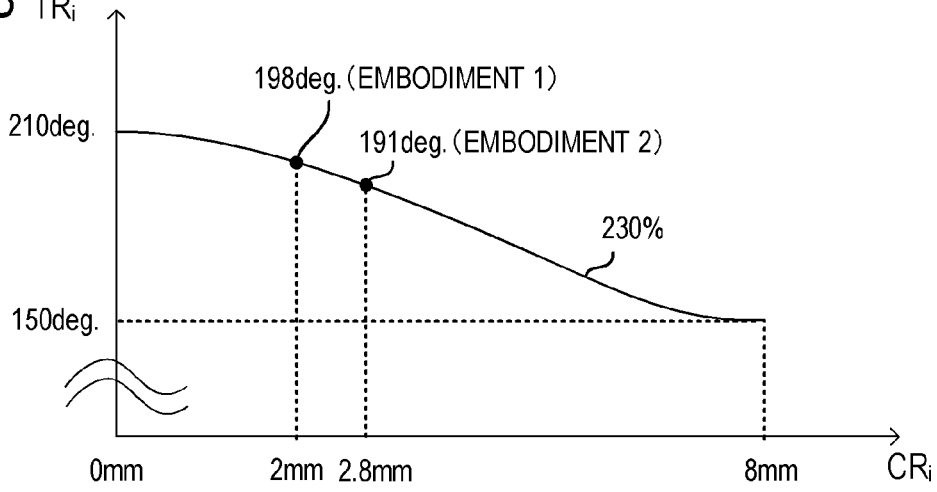
Figure 17:
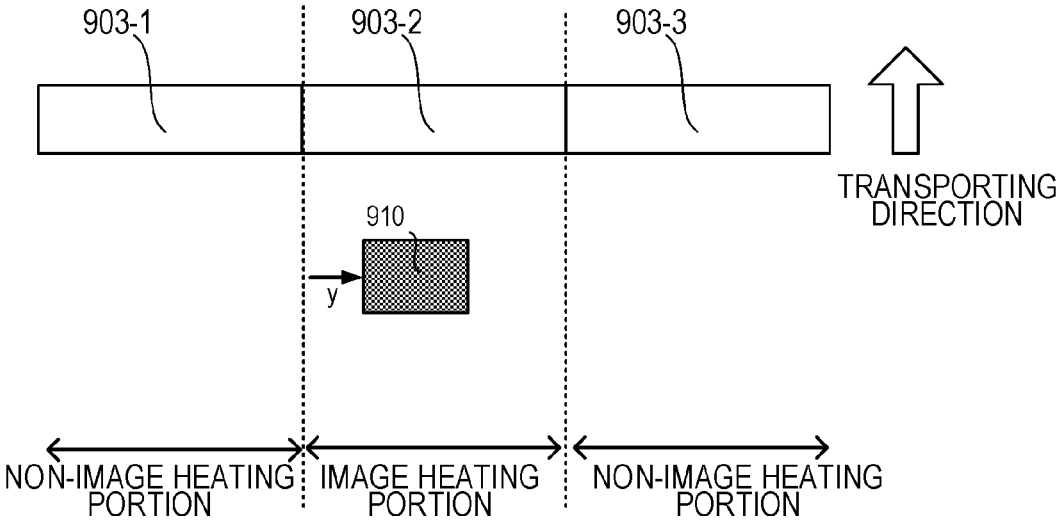
FIG. 17 is a diagram depicting heating elements according to Japanese Patent Application Publication No. 2018-4938.
Figure 18A:
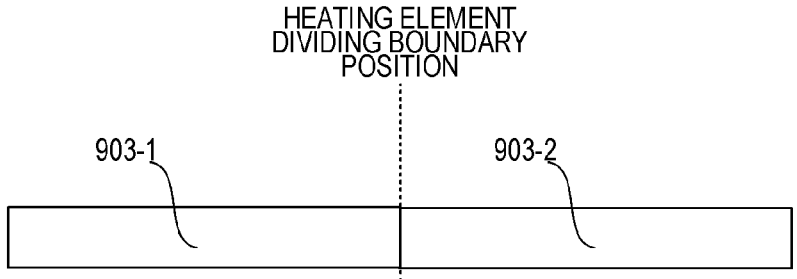
FIG. 18A, FIG. 18B and FIG. 18C are diagrams depicting a problem of the invention disclosed in Japanese Patent Application Publication No. 2018-4938.
Figure 18B:
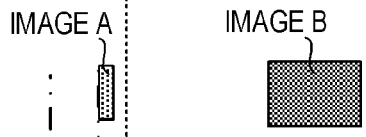
Figure 18C:
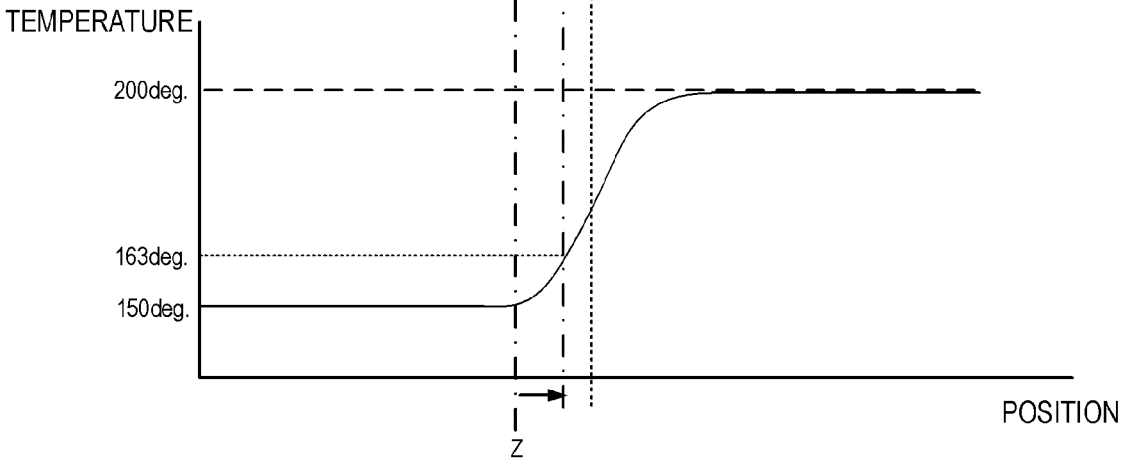

Just like the relationship in FIG. 8B, FIG. 16B indicates that the control temperature is determined based on the image information $CR_i$ in the non-image heating portions adjacent to the image heating portions of Embodiment 1 and Embodiment 2. In FIG. 16B, only the state when $CR_i$=230% is indicated as a representative example. In Embodiment 1, the actual image position is $CR_2$=2.8 mm, since the resolution of the distance of the image information $CR_i$ of Example 1 is 1 mm, but is regarded as $CR_2$=2 mm. In Embodiment 1, the control temperature of $HB_2$ is set to 198 deg. based on the image information of $BR_2$=185% and $CR_2$=2 mm, and the relationship in FIG. 16B. In Embodiment 2, on the other hand, the control temperature of $HB_2$ is set to 191 deg. based on the image information of $BR_2$=195% and $CR_2$=2.8 mm, and the relationship in FIG. 16B. In the same manner, the control temperature of $HB_6$ in Embodiment 1 and in Embodiment 2 are also set.

As a result of measuring power under the above conditions, the average power consumed by the fixing apparatus 200 of Embodiment 2 was 609 W. On the other hand, the average power was 632 W in the case of Comparative Embodiment 2 and was 616 W in the case of Embodiment 1. Embodiment 2 can decrease the control temperatures of $HB_2$ and $HB_6$ than Comparative Embodiment 2 and Embodiment 1, although the temperature of $HB_5$ is slightly higher, and therefore a power saving effect is implemented.

As described above, in the image forming apparatus that adjusts the heating conditions of a plurality of heating blocks disposed in the longer direction in accordance with the image information, a power saving effect can be improved if Embodiment 2 is applied.

Configurations of the above embodiments may be combined as much as possible.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-218910, filed on Nov. 22, 2018, which is hereby incorporated by reference herein in its entirety.

What is claimed is:

1. An image heating apparatus that heats an image formed on a recording material, the image heating apparatus comprising:

a heater including a plurality of heating elements which are arranged in a direction orthogonal to a transporting direction of a recording material;

a control portion capable of individually controlling power to be supplied to the plurality of heating elements so as to individually control the temperature of a plurality of heating regions which are heated by the plurality of heating elements; and an acquisition portion that acquires information on an image formed on a recording material, wherein the control portion divides a region of a recording material, on which an image is formable, into a boundary region and a non-boundary region which are regions divided in a direction orthogonal to the transporting direction so as to correspond to the plurality of heating elements, the boundary region is a region which includes a boundary between one heating element, out of the plurality of heating elements, and an adjacent heating element thereof and overlaps with the one heating element and the adjacent heating element by a predetermined range in the direction orthogonal to the transporting direction, and the non-boundary region is a region that overlaps with the one heating element in a range other than the boundary region, wherein a control target temperature of a heating region that is heated by the one heating element is set to a higher temperature of a first temperature based on information corresponding to the boundary region out of the image information, and a second temperature based on information corresponding to the non-boundary region out of the image information.

2. The image heating apparatus according to claim 1, wherein the information corresponding to the boundary region includes density of an image portion which is a portion of the image included in the boundary region and distance from the non-boundary region to the image portion in a direction orthogonal to the transporting direction.

3. The image heating apparatus according to claim 2, wherein the first temperature is higher as the density of the image portion included in the boundary region is higher.

4. The image heating apparatus according to claim 2, wherein the first temperature is higher as the distance from the non-boundary region to the image portion in the direction orthogonal to the transporting direction is shorter.

5. The image heating apparatus according to claim 1, wherein the boundary region includes one boundary region which is divided between the one heating element and a heating element adjacent to the one heating element on one side in the direction orthogonal to the transporting direction, and another boundary region which is divided between the one heating element and a heating element adjacent to the one heating element on the other side in the direction orthogonal to the transporting direction, wherein the control portion sets the control target temperature to the highest temperature of the first temperature in the one boundary region, the first temperature on the other boundary region and the second temperature.

6. The image heating apparatus according to claim 1, wherein the information corresponding to the non-boundary region includes density of the image portion included in the non-boundary region.

7. The image heating apparatus according to claim 1, wherein the one heating element is a heating element for heating a heating region, out of the plurality of heating regions, of which a heating range does not overlap with the image.

8. The image heating apparatus according to claim 7, wherein the control target temperature of the heating region, out of the plurality of heating regions, of which the heating range overlaps with the image is set based on the density of the image portion that overlaps with the heating region, out of the image.

9. The image heating apparatus according to claim 1, wherein the apparatus further includes a tubular film of which an inner surface contacts the heater.

10. An image forming apparatus, comprising:

an image forming portion that forms an image on a recording material; and a fixing portion that fixes the image formed on the recording material to the recording material, wherein the fixing portion is the image heating apparatus according to claim 1.

11. A control method of an image heating apparatus that heats an image formed on a recording material, the image heating apparatus comprising:

a heater including a plurality of heating elements which are arranged in a direction orthogonal to a transporting direction of a recording material;

a control portion capable of individually controlling power to be supplied to the plurality of heating elements so as to individually control temperatures of a plurality of heating regions which are heated by the plurality of heating elements; and an acquisition portion that acquires information on an image formed on a recording material, the control method comprising:

a first step where a region of a recording material, on which an image is formable, is divided into a boundary region and a non-boundary region which are regions divided in a direction orthogonal to the transporting direction so as to correspond to the plurality of heating elements, the boundary region is a region which includes a boundary between one heating element, out of the plurality of heating elements, and an adjacent heating element thereof and overlaps with the one heating element and the adjacent heating element by a predetermined range in the direction orthogonal to the transporting direction, and the non-boundary region is a region that overlaps with the one heating element in a range other than the boundary region, and a first temperature based on information corresponding to the boundary region out of the image information, and a second temperature based on information corresponding to the non-boundary region out of the image information are acquired; and a second step where the control target temperature of a heating region that is heated by the one heating element is set to be a higher temperature of the first temperature and the second temperature.

12. The control method according to claim 11, wherein the information corresponding to the boundary region includes density of an image portion included in the boundary region of the image and distance from the non-boundary region to the image portion in a direction orthogonal to the transporting direction.

13. The control method according to claim 12, wherein the first temperature is higher as the density of the image portion included in the boundary region is higher.

14. The control method according to claim 12, wherein the first temperature is higher as the distance from the non-boundary region to the image portion in the direction orthogonal to the transporting direction is shorter.

15. The control method according to claim 11, wherein the boundary region includes one boundary region which is divided between the one heating element and a heating element adjacent to the one heating element on one side in a direction orthogonal to the transporting direction, and another boundary region which is divided between the one heating element and a heating element adjacent to the one heating element on the other side in the direction orthogonal to the transporting direction, wherein, in the second step, the control target temperature is set to the highest temperature of the first temperature in the one boundary region, the first temperature in the other boundary region and the second temperature.

16. The control method according to claim 11, wherein the information corresponding to the non-boundary region includes density of the image portion included in the non-boundary region.

17. The control method according to claim 11, wherein the one heating element is a heating element for heating a heating region, out of the plurality of heating regions, of which a heating range does not overlap with the image.

18. The control method according to claim 17, wherein the control target temperature of the heating region, out of the plurality of heating regions, of which the heating range overlaps with the image is set based on the density of the image portion that overlaps with the heating region, out of the image.

* * * * *